US008219005B2

(12) United States Patent
Suzuki et al.

(10) Patent No.: US 8,219,005 B2
(45) Date of Patent: Jul. 10, 2012

(54) DEVELOPING DEVICE, IMAGE FORMING APPARATUS AND DEVELOPER CARTRIDGE

(75) Inventors: Shiro Suzuki, Ebina (JP); Tetsuji Okamoto, Ebina (JP); Koichi Watanabe, Ebina (JP); Atsuyuki Kitamura, Ebina (JP); Masahiro Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 730 days.

(21) Appl. No.: 12/222,713

(22) Filed: Aug. 14, 2008

(65) Prior Publication Data

US 2009/0169262 A1 Jul. 2, 2009

(30) Foreign Application Priority Data

Dec. 28, 2007 (JP) ..... 2007-341419
Mar. 11, 2008 (JP) ..... 2008-060853
Mar. 11, 2008 (JP) ..... 2008-060854

(51) Int. Cl.
*G03G 15/01* (2006.01)
*G03G 15/095* (2006.01)

(52) U.S. Cl. ..... 399/225; 399/227; 399/264

(58) Field of Classification Search ..... 399/225–227
See application file for complete search history.

(56) References Cited

U.S. PATENT DOCUMENTS 4,922,301 A 5/1990 Katoh et al. ..... 355/251
4,924,806 A * 5/1990 Mizuno et al. ..... 399/225
5,146,278 A * 9/1992 Kroll et al. ..... 399/225
7,366,457 B2 * 4/2008 Ono ..... 399/344
2003/0142997 A1 7/2003 Izumi ..... 399/227
2006/0002750 A1 1/2006 Ono ..... 399/359

FOREIGN PATENT DOCUMENTS

JP 61-020961 1/1986
JP 5-158321 A 6/1993
JP 8-5479 2/1996
JP 8-5479-UM 2/1996
JP 11-231649 8/1999
JP 2000-276025 10/2000
JP 2001-022182 1/2001
JP 2002-148921 5/2002
JP 2002-148921 A 5/2002
JP 2002-182468 6/2002
JP 2007-121960 5/2007

OTHER PUBLICATIONS

Korean Office Action dated Apr. 25, 2012 for corresponding Patent Application No. 2008-0091132.

* cited by examiner

*Primary Examiner* — Hoang Ngo
(74) *Attorney, Agent, or Firm* — Morgan, Lewis & Bockius LLP

(57) ABSTRACT

A developing device includes: a developer carrying member that supplies developer to an image carrying member; plural developer supply members, containing different color developers, that supply the developers to the developer carrying member in a developer supply position; a conveyance member that sequentially conveys the plural developer supply members to the developer supply position; and a peeling member that peels off developer, remained after supply of the developer by the developer carrying member to the image carrying member, from the developer carrying member.

21 Claims, 17 Drawing Sheets

DEVELOPING DEVICE, IMAGE FORMING APPARATUS AND DEVELOPER CARTRIDGE

CROSS-REFERENCE TO RELATED APPLICATIONS

This application is based on and claims priority under 35 USC 119 from Japanese Patent Application Nos. 2007-341419 filed Dec. 28, 2007, 2008-060853 filed Mar. 11, 2008, and 2008-060854 filed Mar. 11, 2008.

BACKGROUND

Technical Field

The present invention relates to a developing device, an image forming apparatus and a developer cartridge.

SUMMARY

According to an aspect of the present invention, there is provided a developing device including: a developer carrying member that supplies developer to an image carrying member; plural developer supply members, containing different color developers, that supply the developers to the developer carrying member in a developer supply position; a conveyance member that sequentially conveys the plural developer supply members to the developer supply position; and a peeling member that peels off developer, remained after supply of the developer by the developer carrying member to the image carrying member, from the developer carrying member.

BRIEF DESCRIPTION OF THE DRAWINGS

Exemplary embodiments of the present invention will be described in detail based on the following figures, wherein.

DETAILED DESCRIPTION

Next, a first exemplary embodiment of the present invention will be described based on the drawings.

Figure 1:
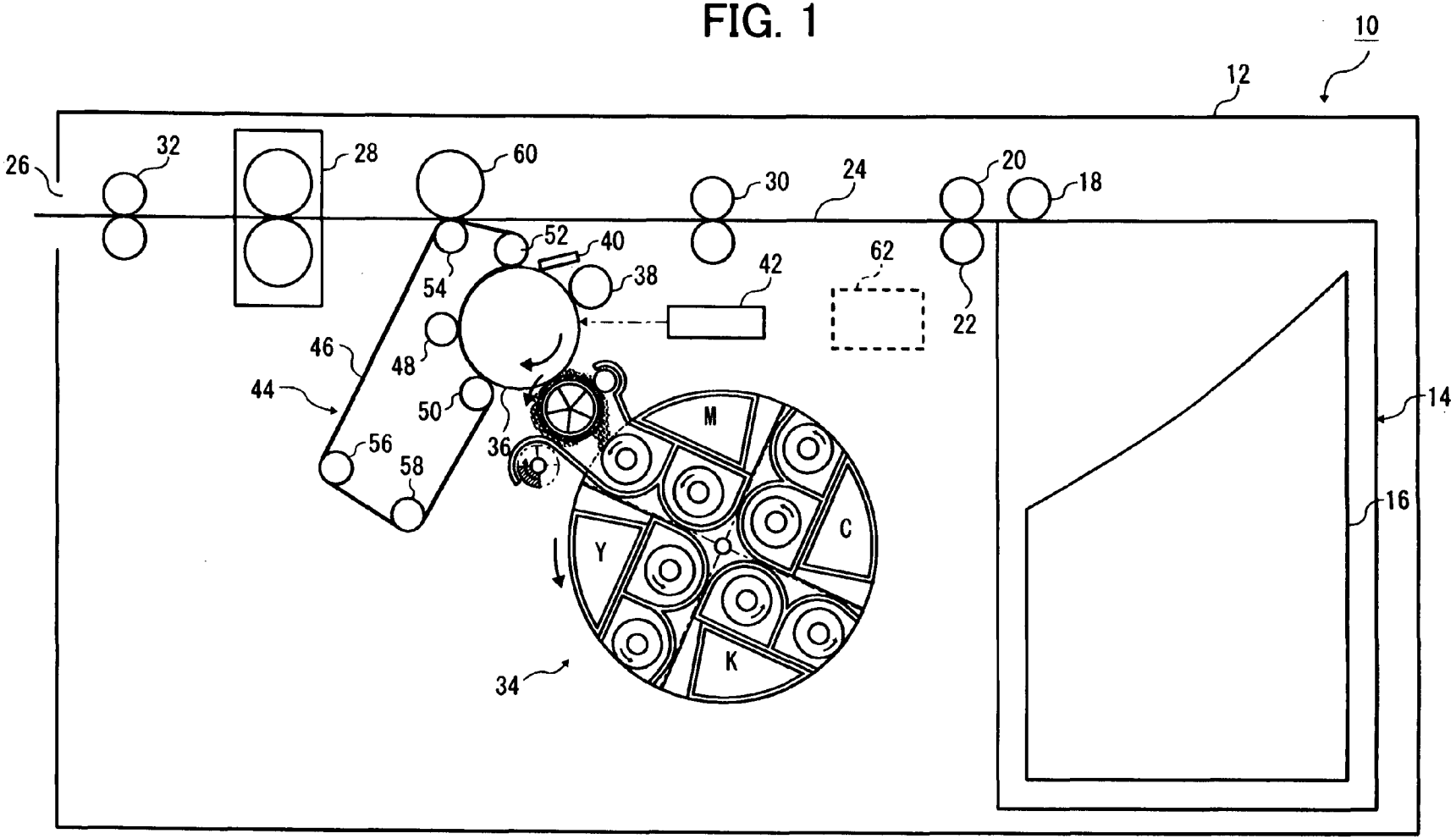
FIG. 1 is a cross-sectional view schematically showing the structure of an image forming apparatus according to a first exemplary embodiment of the present invention.

FIG. 1 schematically shows the structure of an image forming apparatus 10 according to the first exemplary embodiment of the present invention. The image forming apparatus 10 has an image forming apparatus main body 12. A paper feed unit 14 which is e.g. a single-stage unit is provided in the rear side (right side in FIG. 1) of the image forming apparatus main body 12.

The paper feed unit 14 has a paper feed cassette 16 in which print sheets are contained. A pickup roller 18 to pick up a print sheet from the paper cassette 16 is provided above the paper feed cassette 16, and a feed roller 20 and a retard roller 22 are provided ahead of the pickup roller 18.

The feed roller 20 is driven by a drive unit (not shown), and is rotated to feed a print sheet toward a conveyance path 24 to be described later. The retard roller 22 is in press-contact with the feed roller 20 and is rotatable in correspondence with the rotation of the feed roller 20. The retard roller 22 is rotated along with the feed roller 20 to feed the print sheets one by one toward the conveyance path 24 to be described later.

The conveyance path 24 is a print sheet path from the feed roller 20 to a discharge outlet 26. The conveyance path 24, provided in an upper part of the image forming apparatus main body 12, is formed approximately horizontally from the paper feed unit 14 to the discharge outlet 26. In the conveyance path 24, a second transfer roller 60 and a second transfer backup roller 54 to be described later are provided on the upstream side of a fixing device 28, and a registration roller 30 is provided on the upstream side of the second transfer roller 60 and the second transfer backup roller 54. Further, in the conveyance path 24, a discharge roller 32 is provided in the vicinity of the discharge outlet 26.

Accordingly, the print sheets picked up with the pickup roller 18 from the paper feed cassette 16 of the paper feed unit 14 are retarded with the feed roller 20 and the retard roller 22, and only the top sheet is guided onto the conveyance path 24. Then the print sheet is temporarily stopped with the registration roller 30, and at predetermined timing, a developer image is transferred onto the sheet while the sheet is passed between the second transfer roller 60 and the second transfer backup roller 54 to be described later. The transferred developer image is fixed to the print sheet by the fixing device 28. The print sheet is discharged with the discharge roller 32 from the discharge outlet 26.

The image forming apparatus main body 12 is provided with a developing device 34 in e.g. its approximate central portion. The developing device 34 visualizes an electrostatic latent image held on an image carrying member 36 to be described later with yellow, magenta, cyan and black color developers.

The image carrying member 36 having e.g. a photoreceptor is provided so as to be in press-contact with the developing device 34 from a front upper position in the image forming apparatus 10. A charging device 38 having e.g. a charging roller to uniformly charge the image carrying member 36 is provided on the rear side of the image carrying member 36. That is, a developing bias is applied to the image carrying member 36. Further, an image carrying member cleaner 40 is provided in contact with the image carrying member 36 on the upstream side of the charging device 38 in a rotational direction of the image carrying member 36. The image carrying member cleaner 40 removes developer remaining on the image carrying member 36 after e.g. first transfer.

An exposure device 42 to write a latent image using light such as laser beam on the image carrying member 36 charged by the charging device 38 is provided above the developing device 34. Further, an intermediate transfer device 44 on which a developer image visualized by the developing device 34 is first-transferred in a first transfer position and which conveys the developer image to a second transfer position to be described later, is provided on the front side of the image carrying member 36.

The intermediate transfer device 44 has an intermediate transfer body 46 such as an intermediate transfer belt, a first transfer roller 48, support rollers 50 and 52, the second transfer backup roller 54 and tension rollers 56 and 58. The intermediate transfer body 46 has a first transfer portion in wrap-contact with the image carrying member 36 between the support roller 50 provided upstream of the first transfer roller 48 and the support roller 52 provided downstream of the first transfer roller 48. The intermediate transfer body 46 winds around the image carrying member 36 only in a predetermined range, and rotates in accordance with the rotation of the image carrying member 36. The tension rollers 56 and 58 provide a predetermined tension force to the intermediate transfer body 46. Developer images on the image carrying member 36, i.e., yellow, magenta, cyan and black developer images, in e.g. this order, are first-transferred while they are overlaid onto the intermediate transfer body 46 with the first transfer roller 48. The intermediate transfer body 46 conveys the first-transferred developer image toward the second transfer roller 60 to be described later.

In the intermediate transfer device 44, the second transfer roller 60 is provided to be opposite to the second transfer backup roller 54 with the conveyance path 24 therebetween. That is, the second transfer position is set between the second transfer roller 60 and the second transfer backup roller 54. The second transfer roller 60 second-transfers the developer image first-transferred on the intermediate transfer body 46 onto a print sheet in the second transfer position by assistance of the second transfer backup roller 54. Note that the second transfer roller 60 is away from the intermediate transfer body 46 while the intermediate transfer body 46 rotates three times, i.e., while the yellow, magenta and cyan developer images are conveyed. When the black developer image has been transferred, the second transfer roller 60 becomes in contact with the intermediate transfer body 46. Note that a predetermined potential difference is caused between the second transfer roller 60 and the second transfer backup roller 54. For example, when a high voltage is applied to the second transfer roller 60, the second transfer backup roller 54 is connected to the ground (GND) or the like.

The fixing device 28 is provided downstream of the second transfer position in the conveyance path 24. The fixing device 28 has a heating roller and a pressure roller. The fixing device 28 fixes the developer image, second-transferred on the print sheet with the second transfer roller 60 and the second transfer backup roller 54, to the print sheet, and conveys the sheet toward the discharger roller 32.

Further, a controller 62 to control the respective constituent elements of the image forming apparatus 10 is provided in the image forming apparatus 10.

Next, the developing device 34 will be described in detail.

Figure 2:
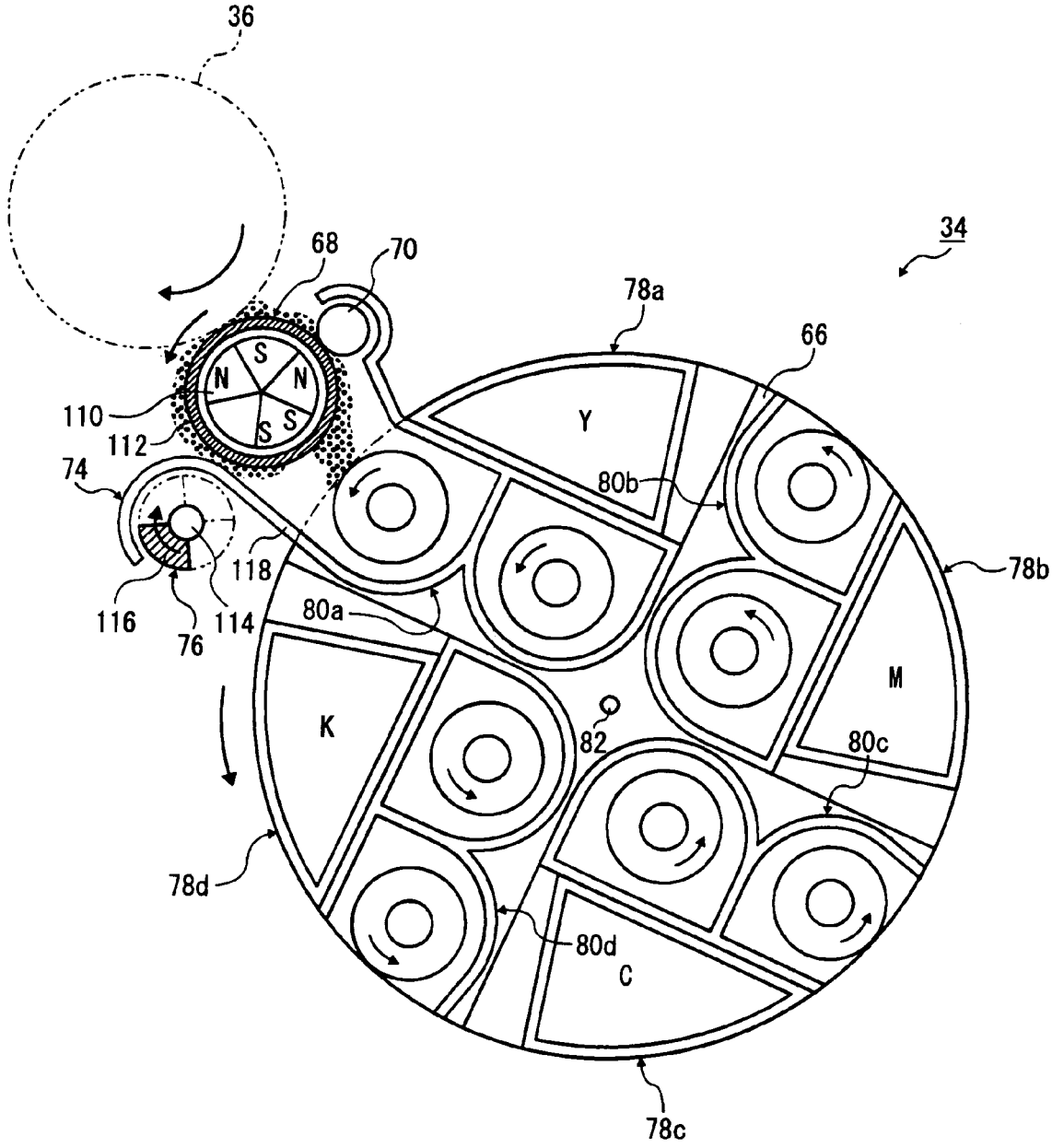
FIG. 2 is a cross-sectional view showing an example of a developing device.
Figure 3:
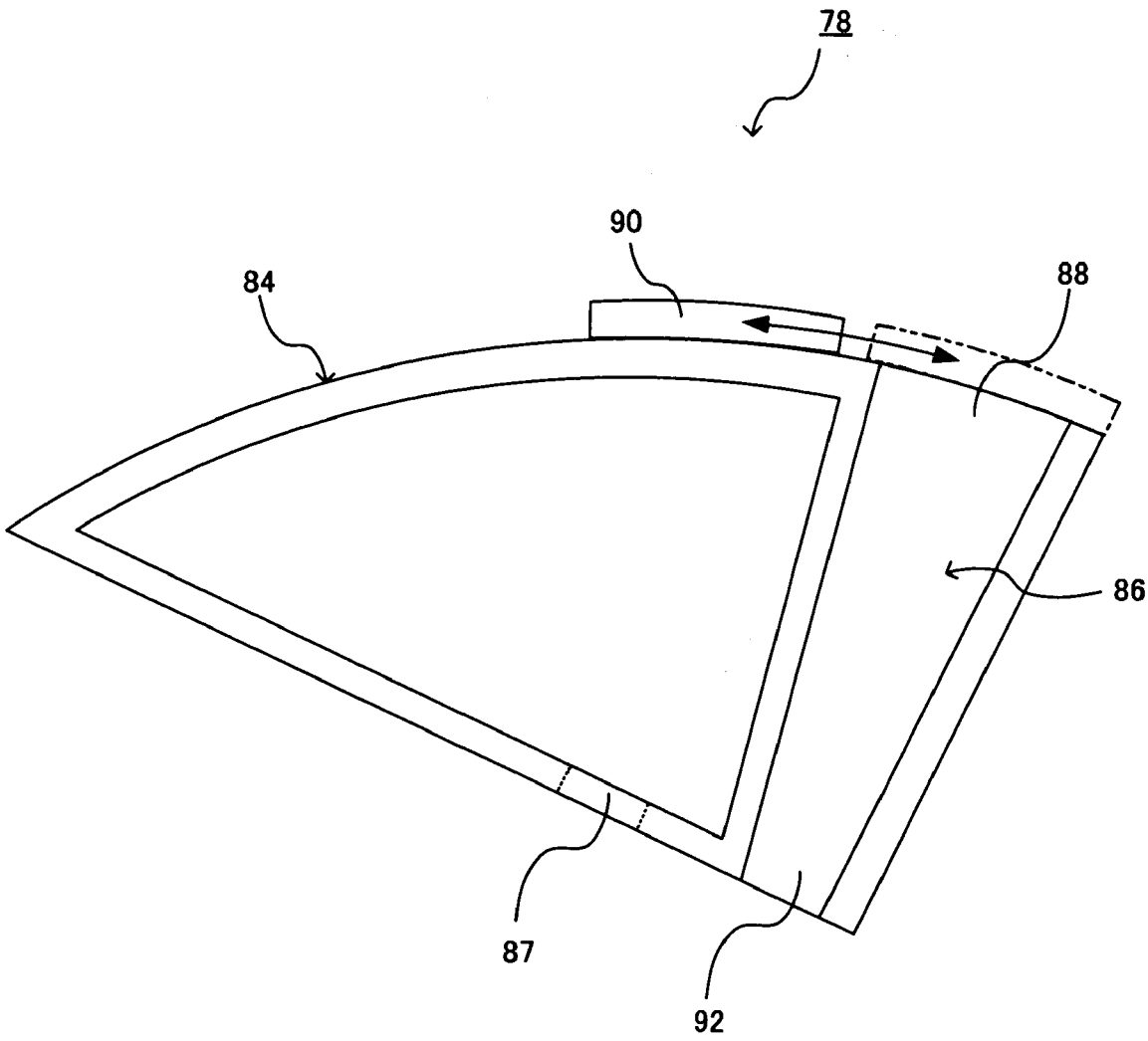
FIG. 3 is a cross-sectional view showing the details of a toner cartridge.
Figure 4:
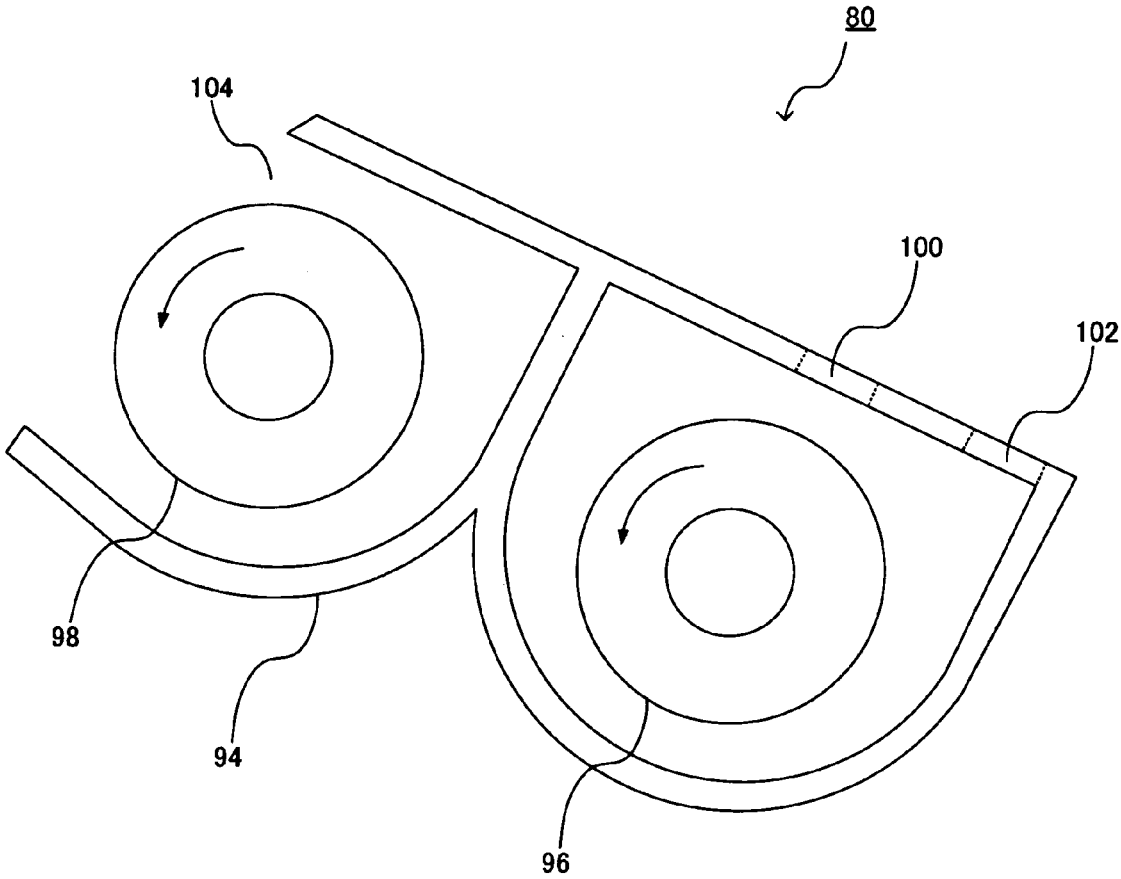
FIG. 4 is a cross-sectional view showing the details of a developer supply member.

FIGS. 2 to 4 show the details of the developing device 34. The developing device 34 has a rotary body (conveyance member) 66, a developing roller 68, a layer thickness regulating member 70, a developing roller accommodation wall 74, a peeling member 76, toner cartridges (supply developer containers) 78*a* to 78*d* and developer supply members 80*a* to 80*d*.

Hereinbelow, when any one of plural constituent elements such as developer containers 80*a* to 80*d* is described without particularly specifying it, it may be simply referred to as e.g. "developer container 80".

The toner cartridges 78*a* to 78*d* to sequentially supply yellow, magenta, cyan and black developers to the developing roller 68 and the developer supply members 80*a* to 80*d* are removably provided in the rotary body 66. The rotary body 66 is rotatably provided e.g. counterclockwise (counterclockwise in FIG. 2) about a rotation shaft 82, such that the developer supply members 80*a* to 80*d* are sequentially moved to a position opposite to the developing roller 68 (developer supply position). Note that the rotation angle of the rotary body 66 is controlled with a pulse motor or the like (not shown) controlled by a controller 62. Further, the rotary body 66 may be positioned with a ratchet or the like.

Note that the developers contained in the developer supply members 80*a* to 80*d* are e.g. two component developer including non-magnetic toner and magnetic carrier.

As shown in FIG. 3, the toner cartridge 78 has an unused toner container 84 containing unused toner and a developer collecting member 86 to collect developer peeled off (collected) by the peeling member 76 from the developing roller 68. The unused toner container 84 is provided with a supply port 87 to supply the unused toner to the developer supply member 80. The developer collecting member 86 is provided with an opening 88 to collect the developer peeled off by the peeling member 76, an opening/closing member 90 to open/close the opening 88, and a discharge port 92 to discharge (supply) the collected developer to the developer supply member 80.

As shown in FIG. 4, the developer supply member 80 has a supply member main body 94, a first auger 96 and a second auger 98. The supply member main body 94 is provided with a first inlet 100 to receive toner from the toner cartridge 78, a second inlet 102 to receive developer collected in the developer collecting member 86, and an opening 104 to supply the developer to the developing roller 68. The first auger 96 conveys the toner supplied from the toner cartridge 78 and the developer received from the developer collecting member 86, while stirring the developer, toward the second auger 98. The second auger 98 stirs the developer, and when the opening 104 has been moved to a position opposite to the developing roller 68 by rotation of the rotary body 66, conveys and supplies the developer toward the developing roller 68. That is, the developer collected in the developer collecting member 68 is reused as developer supplied to the developing roller 68.

Note that the developer is conveyed so as to be circulated in the supply device main body 94 while it is stirred by the first auger 96 and the second auger 98 such that the nonmagnetic toner is attached around the magnetic carrier.

The developing roller 68 (FIG. 2) has a fixed magnet 110 extending in its axial direction, with plural N poles and S poles, and a sleeve 112, including the magnet 110, which rotates and conveys developer in its circumferential direction in correspondence with a magnetic force of the magnet 110. In the magnet member 110, magnetic poles (developing poles) arranged to be opposite to the image carrying member 36 to supply developer on the developing roller 68 to the image carrying member 36, magnetic poles (pick-up poles) to attract developer from the developer container 80 are provided in e.g. upper positions on the developer container 80 side, and magnetic poles (peel-off poles) to repel the developer are provided in e.g. lower positions on the developer container 80 side. Further, the developing roller 68 is accommodated in a developing roller accommodation wall 74 opened such that a portion opposite to the image carrying member 36 is exposed. The developing roller 68 supplies the respective color developers held with the magnetic force to the image carrying member 36 while forming a predetermined gap between the roller and the image carrying member 36.

The layer thickness regulating member 70 regulates the layer thickness of developer attached to the surface of the developing roller 68 (held on the developing roller 68). A guide portion 118 to guide the developer to the developer supply member 80 is formed in the developing roller accommodation wall 74.

The peeling member 76 has a rotation shaft 114 provided approximately parallel to the developing roller 68 and a magnet 116 of e.g. rare earth which rotates clockwise (clockwise in FIG. 2) about the rotation shaft 114 under the control of the controller 62. The peeling member 76 peels off the developer, remained on the developing roller 68 after supply of the developer from the developing roller 68 to the image carrying member 36, with its magnetic force, and guides the developer to the developer supply member 80 via the above-described guide portion 118.

Figure 5A:
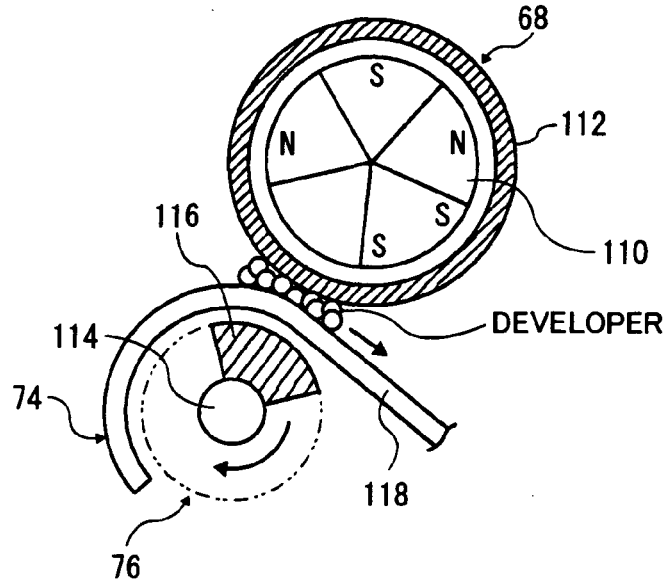
FIGS. 5A to 5C are expanded cross-sectional views showing a state where a magnet peels off developer remaining on a developing roller (including developer around a peel-off position)
Figure 5B:
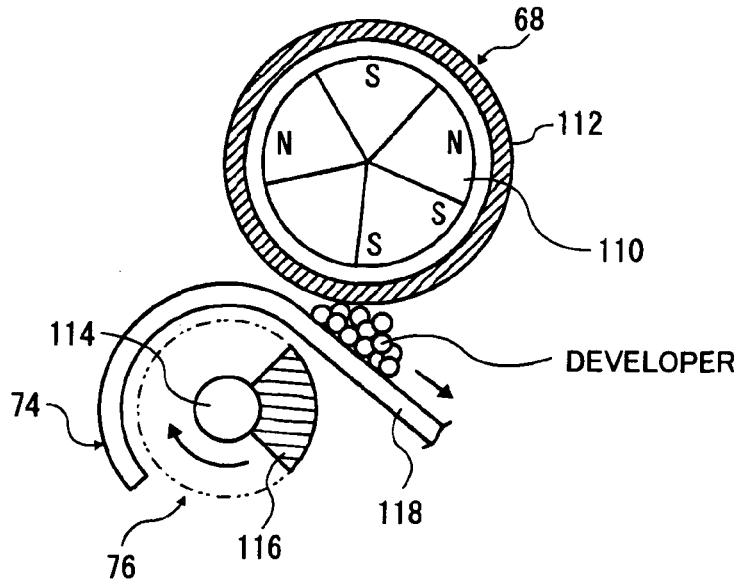
Figure 5C:
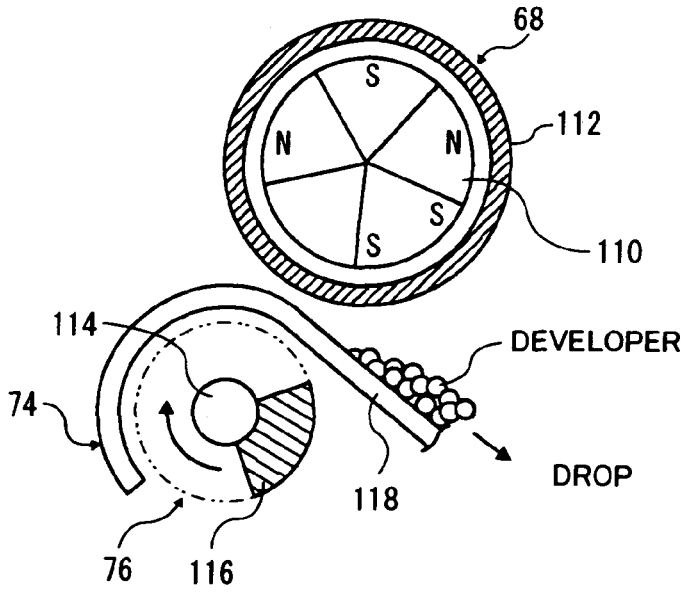

FIGS. 5A to 5C are expanded cross-sectional views showing a state where developer remaining on the developing roller 68 (including developer around the peel-off position) is peeled off by the magnet 116. As shown in FIG. 5A, when the peeling member 76 provided below the developing roller 68 via the developing roller accommodation wall 74 rotates and the magnet 116 approaches the developing roller 68, the magnet 116 attracts the developer to guide portion 118 side. Further, as shown in FIG. 5B, when the peeling member 76 rotates and the magnet 116 begins to move away from the developing roller 68, the developer is peeled off from the developing roller 68 with the magnetic force of the magnet 116. Further, as shown in FIG. 5C, when the peeling member 76 further rotates and the magnet 116 further moves away from the developing roller 68, the developer is moved downward along the guide portion 118 while the developer is attracted with the magnetic force of the magnet 116, and further, drops downward in a region not influenced by the above-described magnetic force. Note that the guide portion 118 is a partition wall partitioning the peeling member 76 from the developer. The guide portion 118 is formed to have an area in which distances to the developing roller 68 and the magnet 116 are increased as the magnet 116 moves away from the position close to the developing roller 68.

In this manner, when the peeling member 76 peels off developer, the magnet 116 approaches the developing roller 68 side such that the magnetic force of the magnet 116 acts on the developer held on the developing roller 68. When the peeling member 76 has peeled off the developer, the magnet 116 rotate-moves (clockwise in FIG. 5B) away from the developing roller 68 such that the peeled developer is isolated from the developing roller 68.

Note that when the developing device 34 visualizes an electrostatic latent image, the controller 62 stops the magnet 116 in a position where the action of the magnetic force of the magnet 116 on the developer held on the developing roller 68 is lowered (on the side opposite to the developing roller 68). Then, when the controller 62 has blocked the supply of developer by rotation of the rotary body 66, the controller 62 rotate-moves the magnet 116 such that the magnetic force of the magnet 116 acts on the developer held on the developing roller 68.

Next, an operation example of the developing device 34 will be described.

Figure 6A:
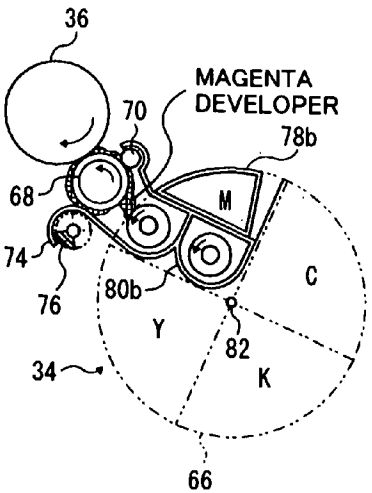
FIGS. 6A to 6G are cross-sectional views showing an operation example of the developing device.

FIGS. 6A to 6G show the outline of the operation example of the developing device 34. As shown in FIG. 6A, when the developing device 34 visualizes an electrostatic latent image with e.g. magenta developer, the developing roller 68 rotates while holding magenta developer supplied from the developer supply member 80*b* positioned in the developer supply position.

Figure 6B:
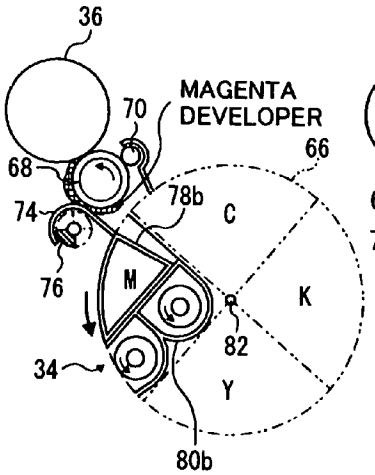

When the visualization with the magenta developer has been completed, then as shown in FIG. 6B, in the developing device 34, the opening/closing member 90 (see FIG. 3) is opened by rotation of the rotary body 66 (less than 90°), the developer supply member 80*b* moves outside the range where the magnetic force of the developer supply magnetic pole of the developing roller 68 acts to block the supply of the magenta developer from the developer supply member 80*b* to the developing roller 68, and the opening 88 stops in a position to cover a portion between the developing roller 68 and the guide portion 118, under the control of the controller 62. That is, a collecting passage to collect the developer peeled off from the developing roller 68 is formed.

Figure 6C:
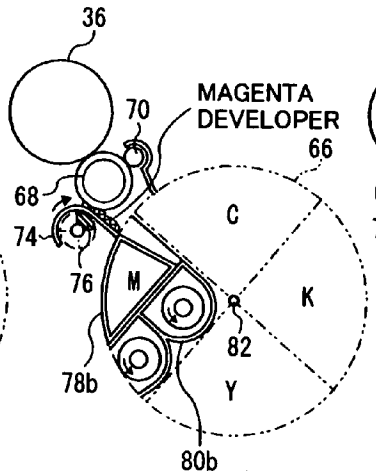

When the opening 88 has stopped between the developing roller 68 and the guide portion 118, then as shown in FIG. 6C, in the developing device 34, the peeling member 76 rotates and peels off the magenta developer held on the developing roller 68 under the control of the controller 62.

Figure 6D:
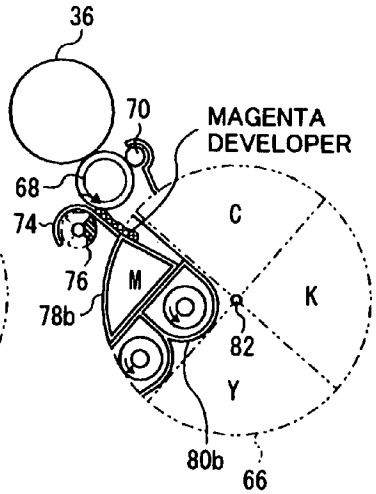

As shown in FIG. 6D, the magenta developer peeled off from the developing roller 68 is guided by the guide portion 118 to the developer collecting member 86 as the magnet 116 moves away from the guide portion 118.

Figure 6E:
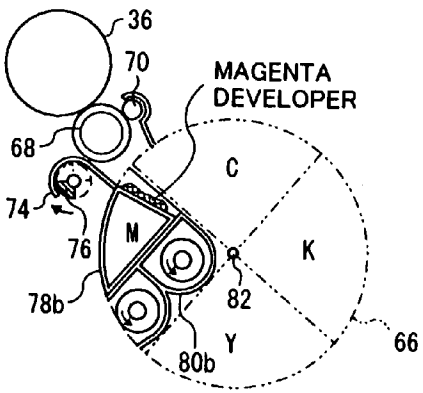

As shown in FIG. 6E, when the magnet 116 further rotates, the magenta developer peeled off from the developing roller 68 is collected (temporarily) in the developer collecting member 86.

Figure 6F:
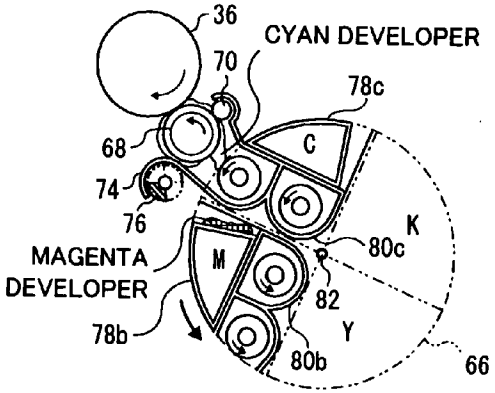

When the magenta developer peeled off from the developing roller 68 has been collected, then as shown in FIG. 6F, in the developing device 34 to visualize the electrostatic latent image with cyan developer, the rotary body 66 rotates such that a developer supply member 80*c* becomes opposite to the developing roller 68. Note that the developing roller 68 rotates while holding cyan developer supplied from the developer supply member 80*c*.

On the other hand, in the toner cartridge 78*b*, the opening/closing member 90 (see FIG. 3) is closed, and the collected magenta developer is still contained in the developer collecting member 86.

Upon color printing, the developing device 34 visualizes an electrostatic latent image with yellow developer, then as described above, visualizes the electrostatic latent image with magenta and cyan developers, thereafter, visualizes the electrostatic latent image with black developer.

Figure 6G:
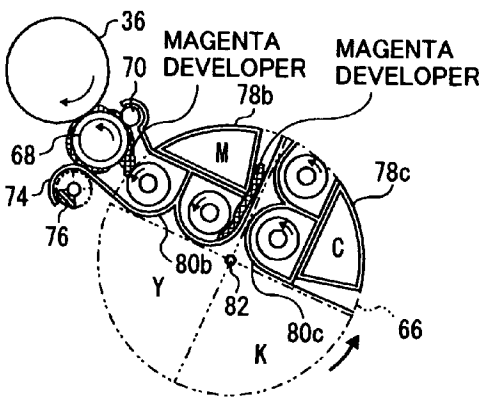

Then, when an electrostatic latent image is visualized with magenta developer again, in the developing device 34, the rotary body 66 rotates such that the developer supply member 80*b* becomes opposite to the developing roller 68 under the control of the controller 62. Note that the slope of the developer collecting member 86 with respect to a gravity direction is changed in accordance with the rotation of the rotary body 66. As shown in FIG. 6G, when the slope of the developer collecting member 86 with respect to the gravity direction is changed in accordance with the rotation of the rotary body 66 such that the discharge outlet 92 (see FIG. 3) is positioned in a lower position, the magenta developer collected in the developer collecting member 86 is supplied to the developer supply member 80*b* (the magenta developer is returned by its own weight to the developer supply member 80*b*).

Next, the operation of the first exemplary embodiment of the present invention will be descried.

When an image forming signal is sent, the image carrying member 36 is uniformly charged by the charger 38, and light is emitted from the exposure device 42 based on the image signal to the charged image carrying member 36. The light from the exposure device 42 exposes the surface of the image carrying member 36, and an electrostatic latent image is formed.

The electrostatic latent image held on the image carrying member 36 is developed by the developing device 34 by developer color, and first-transferred onto the intermediate transfer body 46. Then the respective color developer images are overlaid on the intermediate transfer body 46, and a color image is formed.

The yellow, magenta, cyan and black developers are supplied from the developer containers 80*a* to 80*d* to the developing roller 68. Then, developer excessively supplied to the developer 68 is collected into the same color developer container 80 before supply of the next color developer to the developing roller 68. Upon first transfer, waste developer remaining on the image carrying member 36 is removed with the image carrying member cleaner 40, and is collected.

On the other hand, in accordance with a paper feed signal or the like, print sheets contained in the paper feed cassette 16 are picked up with the pickup roller 18, retarded with the feed roller 20 and the retard roller 22, and only the top print sheet is guided to the conveyance path 24. The print sheet is temporarily stopped with the registration roller 30, and at predetermined timing, guided between the second transfer roller 60 and the second transfer backup roller 54. When the print sheet has been guided between the second transfer roller 60 and the second transfer backup roller 54, the developer image first-transferred on the intermediate transfer body 46 is second-transferred onto the print sheet with the second transfer roller 60 and the second transfer backup roller 54.

The print sheet on which the developer image has been transferred is guided to the fixing device 28, and the developer image is fixed to the print sheet with the heating roller and the pressure roller. The print sheet on which the developer image has been fixed is discharged with the discharge roller 32 from the discharge outlet 26.

Next, a second exemplary embodiment of the present invention will be described based on the drawings.

Figure 7:
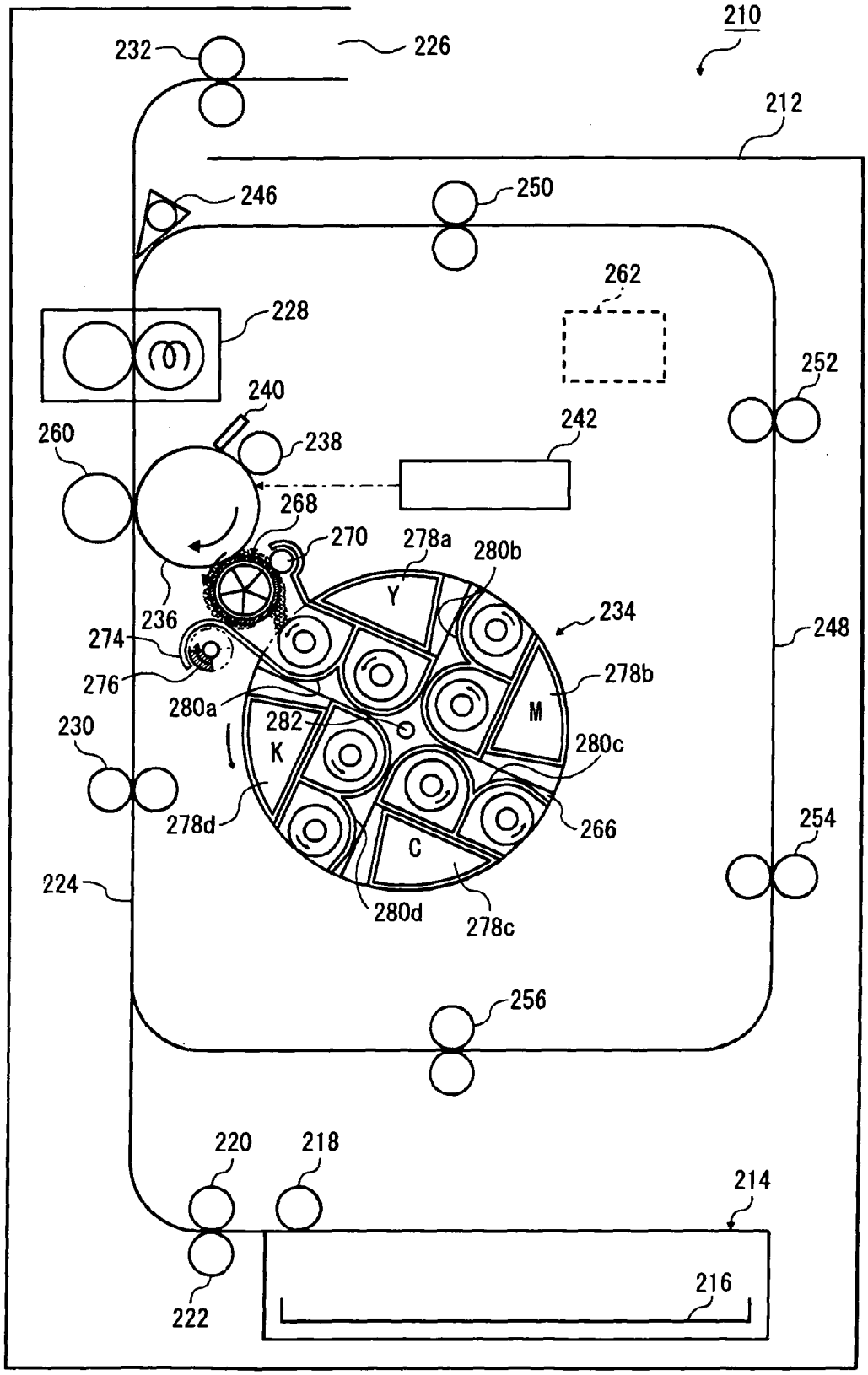
FIG. 7 is a cross-sectional view schematically showing the structure of the image forming apparatus according to a second exemplary embodiment of the present invention.

FIG. 7 is a cross-sectional view schematically showing the structure of an image forming apparatus 210 according to the second exemplary embodiment of the present invention. The image forming apparatus 210 has an image forming apparatus main body 212. A paper feed unit 214 which is e.g. a single-stage unit is provided in a lower part of the image forming apparatus main body 212.

The paper feed unit 214 has a paper feed cassette 216 in which print sheets are contained. A pickup roller 218 to pick up a print sheet from the paper cassette 216 is provided above the paper feed cassette 216, and a feed roller 220 and a retard roller 222 are provided ahead of the pickup roller 218.

The feed roller 220 is driven by a drive unit (not shown), and is rotated to feed a print sheet toward a conveyance path 224 to be described later. The retard roller 222 is in press-contact with the feed roller 220 and is rotatable in correspondence with the rotation of the feed roller 220. The retard roller 222 is rotated in correspondence with rotation of the feed roller 220 to feed the print sheets one by one toward the conveyance path 224 to be described later.

The conveyance path 224 is a print sheet passage from the feed roller 220 to a discharge outlet 226. The conveyance path 224, provided on the rear side of the image forming apparatus main body 212 (left side in FIG. 7), has an approximately vertical portion extending from the paper feed unit 214 to the discharge outlet 226. In the conveyance path 224, an image carrying member 236 and a transfer roller 260 to be described later are provided on the upstream side of a fixing device 228, and a registration roller 230 is provided on the upstream side of the image carrying member 236 and the transfer roller 260. Further, in the conveyance path 224, a discharge roller 232 is provided in the vicinity of the discharge outlet 226.

Accordingly, the print sheets picked up with the pickup roller 218 from the paper feed cassette 216 of the paper feed unit 214 are retarded with the feed roller 220 and the retard roller 222, and only the top sheet is guided onto the conveyance path 224. Then the print sheet is temporarily stopped with the registration roller 230, and at predetermined timing, a developer image in e.g. black is transferred onto the sheet while the sheet is passed between the image carrying member 236 and the transfer roller 260 to be described later. The transferred black developer image is fixed to the print sheet by the fixing device 228. The print sheet is discharged with the discharge roller 232 from the discharge outlet 226.

In the case of color printing, the print sheet is returned to a repeat passage three times. That is, in the conveyance path 224, a part ahead of the discharge roller 232 is branched into two paths, and a switch device 246 is provided in the branch portion and a repeat path 248 to return from the branch portion to the registration roller 230 is formed. Conveyance rollers 250, 252, 254 and 256 are provided on the repeat path 248. In the case of color printing, the switch device 246 is switched to the side to open the repeat path 248, then the print sheet is guided to the repeat path 248, then passed through the registration roller 230, between the image carrying member 236 and the transfer roller 260 and through the fixing device 228 four times, and is discharged from the discharge outlet 226.

The image forming apparatus main body 212 is provided with a developing device 234 in e.g. its approximate central portion. The developing device 234 visualizes an electrostatic latent image held on the image carrying member 236 to be described later with yellow, magenta, cyan and black color developers. Note that the developing device 234, having a rotary body 266, a developing roller 268, a layer thickness regulating member 270, a developing roller accommodation wall 274, a peeling member 276, a toner cartridge (not shown) and developer containers 280*a* to 280*d* and the like, has substantially the same configuration as that of the developing device 34 shown in FIG. 2.

The image carrying member 236 having e.g. a photoreceptor is in contact with the developing device 234 from an upper position on the rear side of the image forming apparatus 210. A charging device 238 having e.g. a charging roller to uniformly charge the image carrying member 236 is provided on the front side of the image carrying member 236. That is, a developing bias is applied to the image carrying member 236.

Further, an image carrying member cleaner 240 is provided in contact with the image carrying member 236 on the upstream side of the charging device 238 in a rotational direction of the image carrying member 236. The image carrying member cleaner 240 removes developer remaining on the image carrying member 236 after transfer.

An exposure device 242 to write an electrostatic latent image using light such as laser beam on the image carrying member 236 charged by the charging device 238 is provided above the developing device 234. Further, the transfer roller 260 to transfer a developer image visualized by the developing device 234 onto a print sheet in a transfer position is provided on the rear side of the image carrying member 236.

The fixing device 228 is provided downstream of the transfer position in the conveyance path 224. The fixing device 228 has a heating roller and a pressure roller. The fixing device 228 fixes the developer image, transferred on the print sheet with the image carrying member 236 and the transfer roller 260, to the print sheet, and conveys the sheet.

Further, a controller 262 to control the respective constituent elements of the image forming apparatus 210 is provided in the image forming apparatus 210.

Next, the operation (color printing) of the second exemplary embodiment of the present invention will be descried.

When an image forming signal is sent, the image carrying member 236 is uniformly charged by the charger 238, and light corresponding to an yellow image is emitted from the exposure device 242 based on the image signal to the charged image carrying member 236. The light from the exposure device 242 exposes the surface of the image carrying member 236, and an electrostatic latent image is formed.

The electrostatic latent image held on the image carrying member 236 is developed with yellow developer supplied to the developing roller 268 of the developing device 234, and transferred onto a print sheet fed from the paper feed unit 214. Then the print sheet on which the yellow developer image has been transferred is guided to the fixing device 228, and the developer image is fixed to the print sheet with the heating roller and the pressure roller. The print sheet on which the yellow toner image is fixed is returned by the switch device 246 to the repeat path 248.

The developer held on the developing roller 268 (remaining on the developing roller 268) is peeled off by the peeling member 276 and is collected in the developer container 280*a*. Then, the rotary body 266 of the developing device 234 rotates, thereby magenta developer is supplied to the developing roller 268. The image carrying member 236 is uniformly charged by the charger 238, and light corresponding to a magenta image is emitted from the exposure device 242 based on the image signal to the charged image carrying member 236. The light from the exposure device 242 exposes the surface of the image carrying member 236, and an electrostatic latent image is formed.

The electrostatic latent image held on the image carrying member 236 is developed with magenta developer supplied to the developing roller 268 of the developing device 234, and transferred onto the print sheet. Then the print sheet on which the magenta developer image has been transferred is guided to the fixing device 228, and the developer image is fixed to the print sheet with the heating roller and the pressure roller. The print sheet on which the magenta developer image is fixed is returned by the switch device 246 to the repeat path 248.

The developer held on the developing roller 268 (remaining on the developing roller 268) is peeled off by the peeling member 276 and is collected in the developer container 280*b*.

As the print sheet is returned to the repeat path 248 three times, as in the case of the yellow and magenta toner images, toner images developed with cyan and black developers are fixed to the print sheet by the fixing device 228, then a color image in which the developer images are overlaid is formed on the print sheet. The print sheet on which the color image is fixed is guided to the discharge roller 232 by the switch device 246 and is discharged.

Next, a first modification of the developing device 34 will be described.

Figure 8:
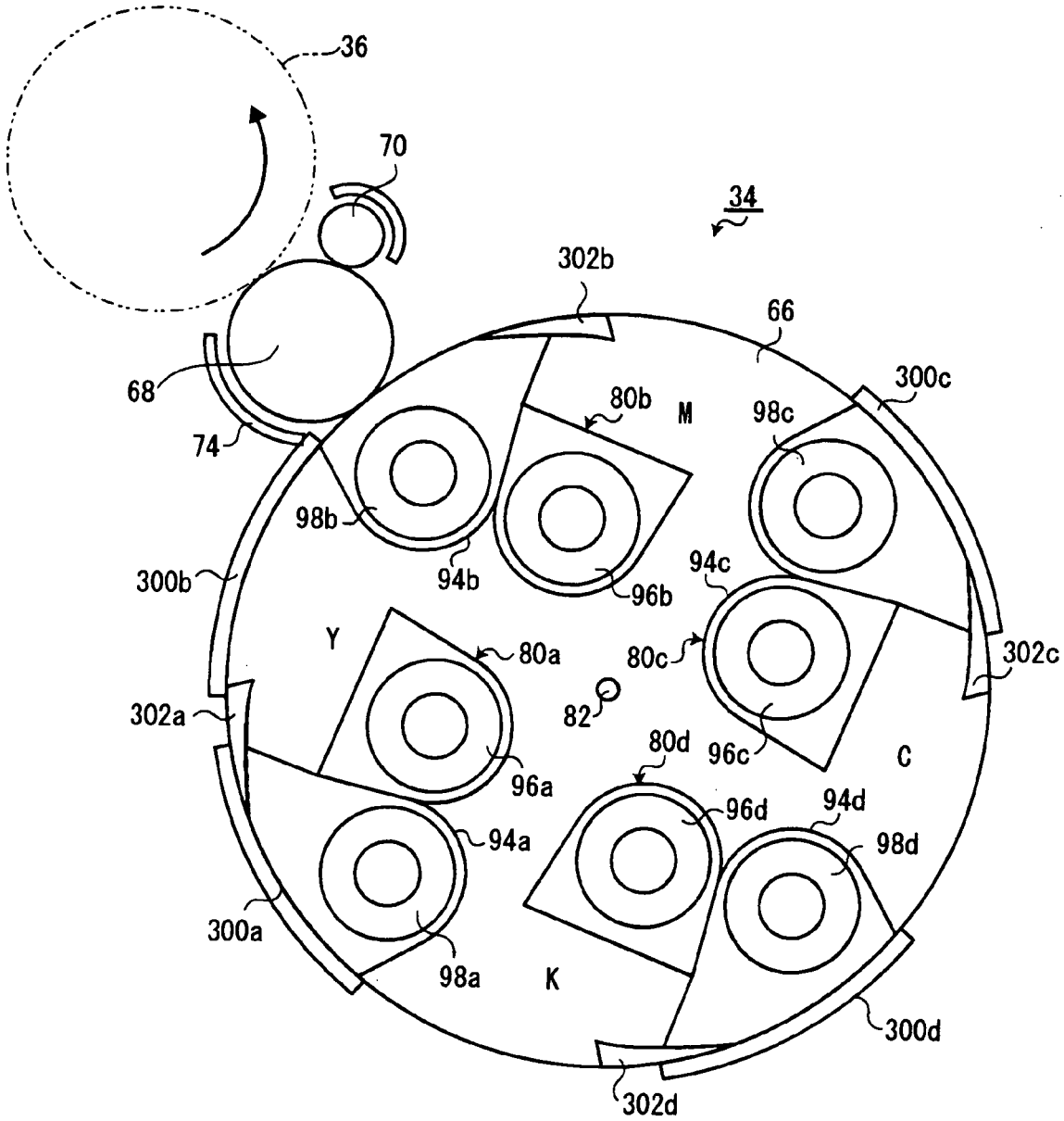
FIG. 8 is a cross-sectional view showing a first modification of the developing device.

FIG. 8 is a cross-sectional view showing the first modification of the developing device 34. Note that in the first modification of the developing device 34, constituent elements substantially the same as those of the developing device 34 shown in FIG. 2 have the same reference numerals.

As shown in FIG. 8, the developer supply member 80 is provided with an opening/closing member 300 to prevent outflow of developer and a scraping member 302 to remove developer remaining on the developing roller 68.

Figure 9A:
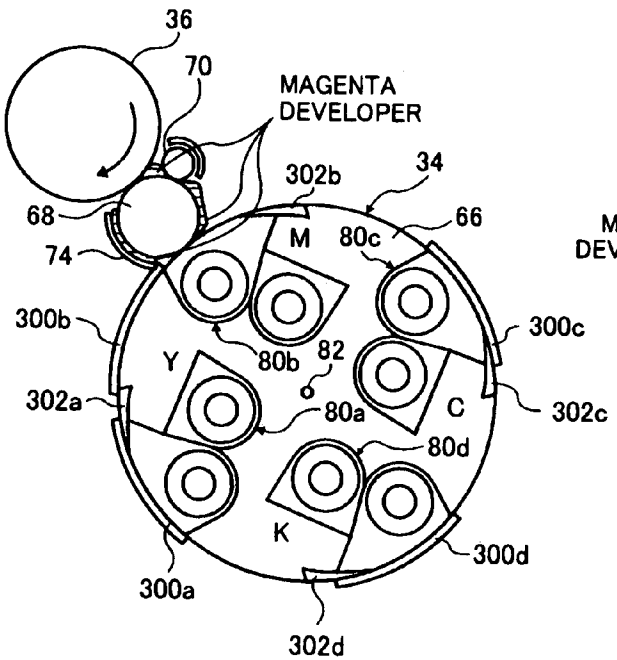
FIGS. 9A to 9C are cross-sectional views showing an operation example of the first modification of the developing device.
Figure 9B:
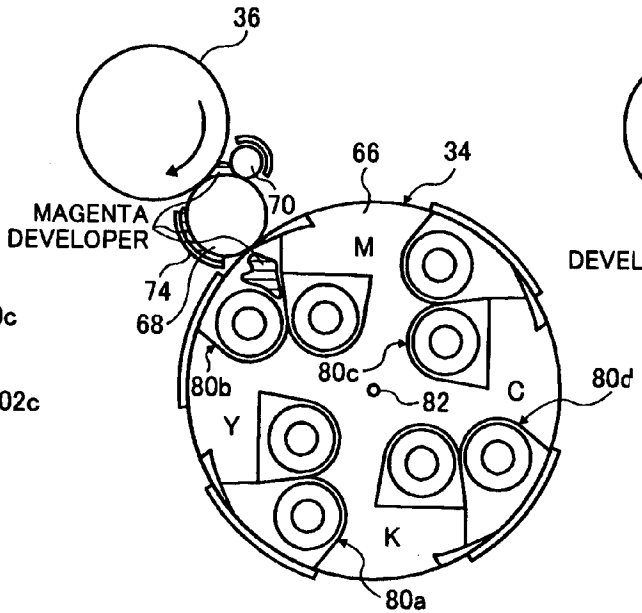
Figure 9C:
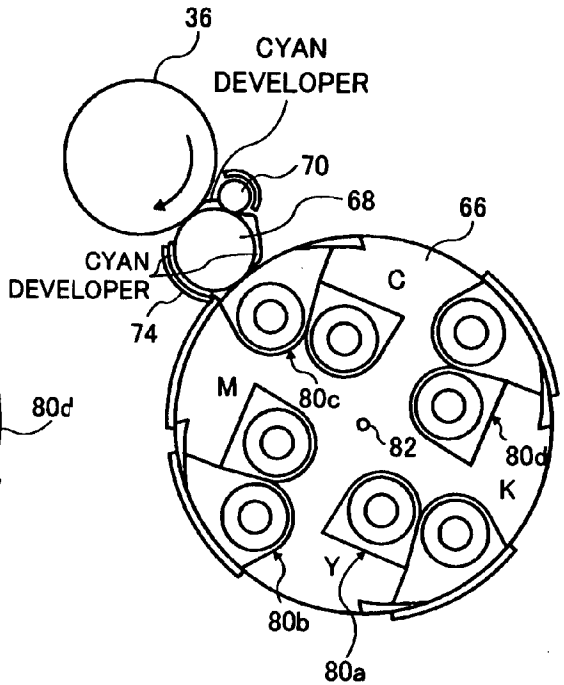

FIGS. 9A to 9C are cross-sectional views showing an operation example of the first modification of the developing device 34. As shown in FIG. 9A, when the developing device 34 visualizes an electrostatic latent image with e.g. magenta developer, the developing roller 68 rotates while holding the magenta developer supplied from the developer supply member 80*b* positioned in the developer supply position.

Note that the distance between the surface of the developing roller 68 and the shaft surface of the second auger 98 is e.g. about 6.5 mm.

When the visualization with the magenta developer has been completed, then as shown in FIG. 9B, in the developing device 34, the opening/closing member 300 of the developer supply member 80*b* moves by rotation of the rotary body 66 at 20°, and the scraping member 302 makes contact with the surface of the developing roller 68 and removes the developer remaining on the developing roller 68, under the control of the controller 62. The developer removed by the scraping member 302 is collected in the supply member main body 94 in a position different from the developer supply position.

Note that the distance between the surface of the developing roller 68 and the shaft surface of the second auger 98 is extended to e.g. about 11 mm, thereby the supply of the developer from the developer supply member 80 to the developing roller 68 is interrupted.

When the magenta developer peeled off from the developing roller 68 has been collected, then as shown in FIG. 9C, in the developing device 34, to visualize the electrostatic latent image with cyan developer, the rotary body 66 rotates 70° such that the developer supply member 80*c* becomes opposite to the developing roller 68. Note that the developing roller 68 rotates while holding the cyan developer supplied from the developer supply member 80*c*.

Next, a second modification of the developing device 34 will be described.

Figure 10:
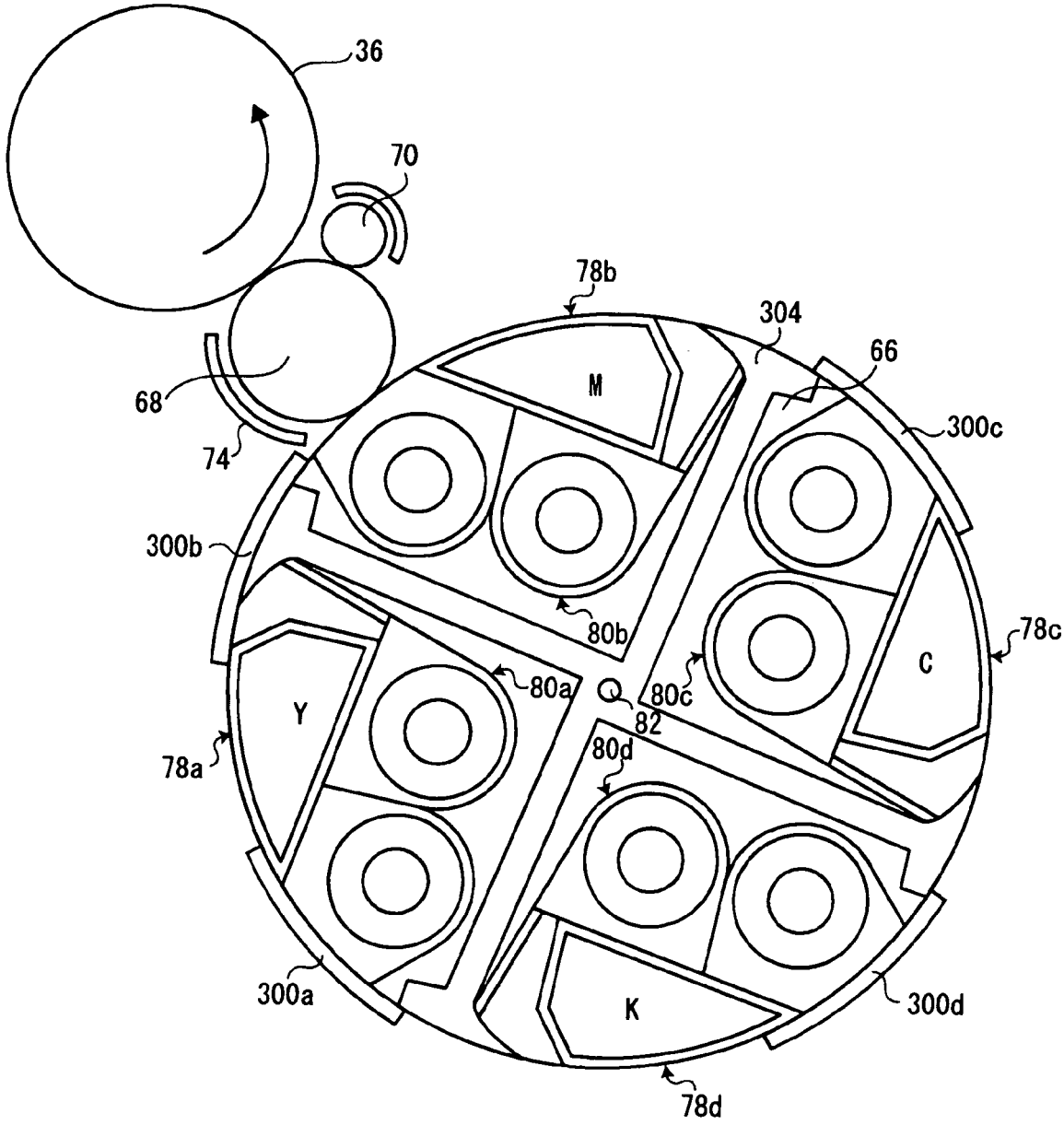
FIG. 10 is a cross-sectional view showing a second modification of the developing device.

FIG. 10 is a cross-sectional view showing the second modification of the developing device 34. Note that in the second modification of the developing device 34, constituent elements substantially the same as those of the developing device 34 shown in FIG. 2 have the same reference numerals.

As shown in FIG. 10, the developer supply member 80 is provided with the opening/closing member 300 to prevent outflow of developer. Further, the rotary body 66, e.g., is provided with a scraping member 304 to remove developer remaining on the developing roller 68.

Figure 11A:
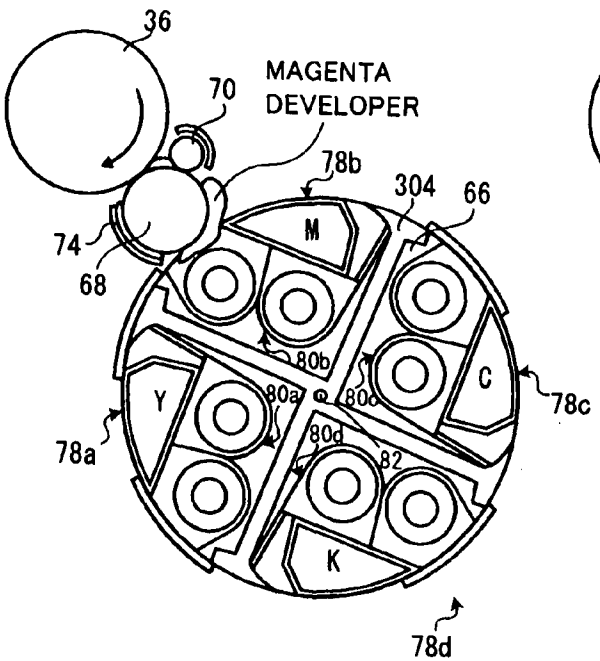
FIGS. 11A to 11C are cross-sectional views showing an operation example of the second modification of the developing device.
Figure 11B:
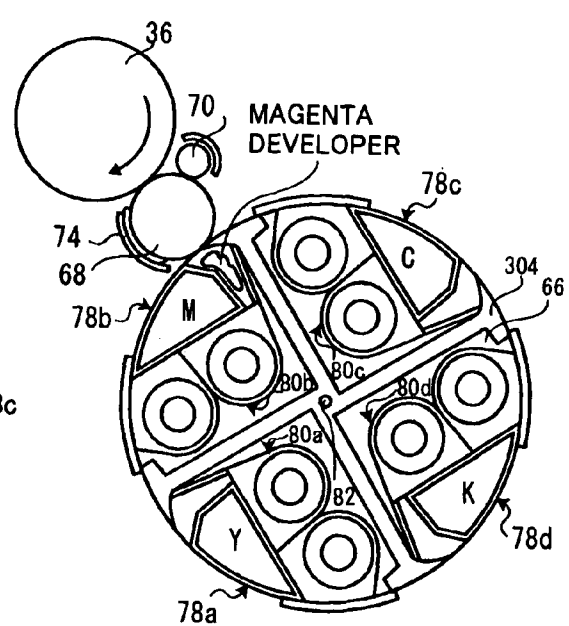
Figure 11C:
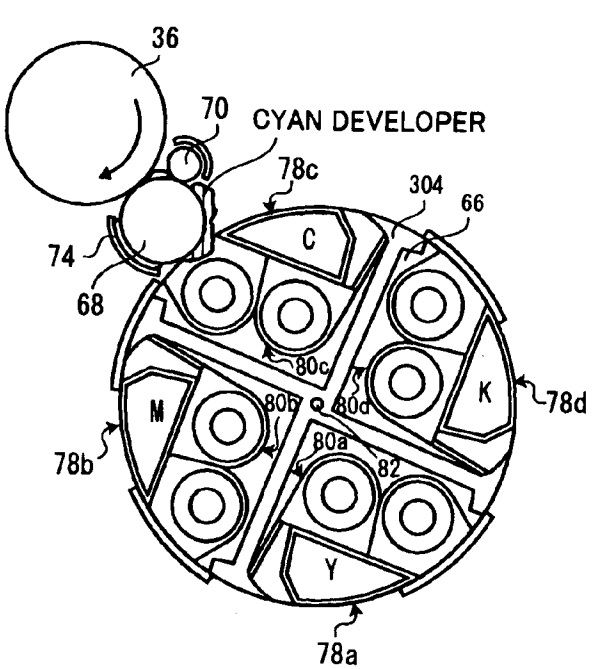

FIGS. 11A to 11C are cross-sectional views showing an operation example of the second modification of the developing device 34. As shown in FIG. 11A, when the developing device 34 visualizes an electrostatic latent image with e.g. magenta developer, the developing roller 68 rotates while holding the magenta developer supplied from the developer supply member 80*b* positioned in the developer supply position.

Note that the distance between the surface of the developing roller 68 and the shaft surface of the second auger 98 is e.g. about 6.5 mm.

When the visualization with the magenta developer has been completed, in the developing device 34, as shown in FIG. 11B, the rotary body 66 rotates e.g. 53° thereby the opening/closing member 300 of the developer supply member 80*b* is closed, the scraping member 304 makes contact with the surface of the developing roller 68 and removes the developer remaining on the developing roller 68, under the control of the controller 62. The developer removed by the scraping member 304 is collected in the toner cartridge 78 in a position different from the developer supply position.

Note that the distance between the surface of the developing roller 68 and the shaft surface of the second auger 98 is extended to e.g. about 20 mm, thereby the supply of the developer from the developer supply member 80 to the developing roller 68 is interrupted.

When the magenta developer peeled off from the developing roller 68 has been collected, then as shown in FIG. 11C, in the developing device 34, to visualize the electrostatic latent image with cyan developer, the rotary body 66 rotates 37° such that the developer supply member 80*c* becomes opposite to the developing roller 68. Note that the developing roller 68 rotates while holding the cyan developer supplied from the developer supply member 80*c*.

Next, a third modification of the developing device 34 will be described.

Figure 12:
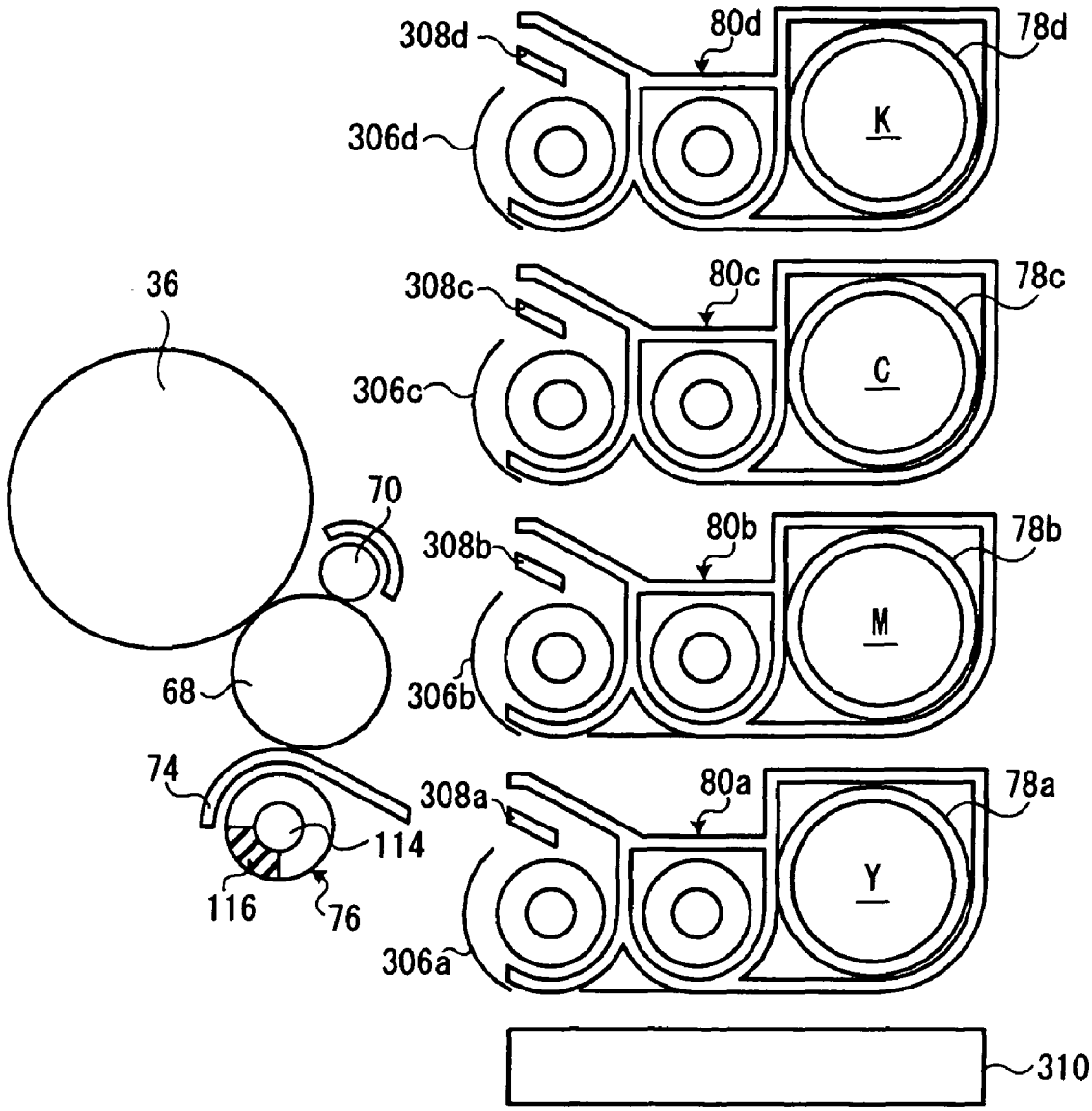
FIG. 12 is a cross-sectional view showing a third modification of the developing device.

FIG. 12 is a cross-sectional view showing the third modification of the developing device 34. Note that in the third modification of the developing device 34, constituent elements substantially the same as those of the developing device 34 shown in FIG. 2 have the same reference numerals.

As shown in FIG. 12, the developer supply member 80 is provided with an opening/closing member 306 to prevent outflow of developer and a guide member 308 to guide developer collected form the developing roller 68.

Note that the developer supply members 80*a* to 80*d* and the toner cartridges 78*a* to 78*d* are moved upward/downward by an elevator (movable body) 310 and moved approximately horizontally toward the developing roller 68 in a predetermined position.

Figure 13A:
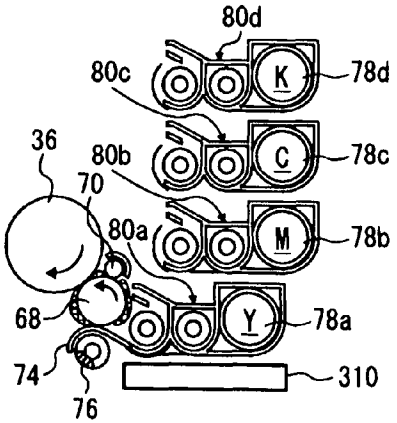
FIGS. 13A to 13H are cross-sectional views showing an operation example of the third modification of the developing device.

FIGS. 13A to 13H are cross-sectional views showing an operation example of the third modification of the developing device. As shown in FIG. 13A, when the developing device 34 visualizes an electrostatic latent image with e.g. yellow developer, the developing roller 68 rotates while holding the yellow developer supplied from the developer supply member 80*b* in the developer supply position.

Figure 13B:
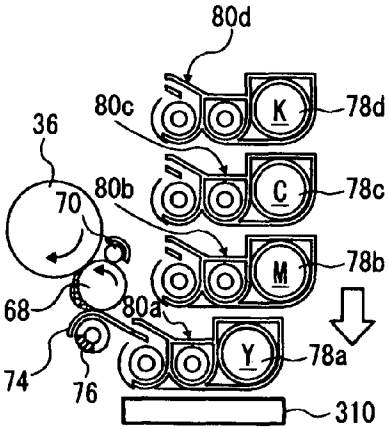

When the visualization with the yellow developer has been completed, then as shown in FIG. 13B, in the developing device 34, the supply of the developer to the developing roller 68 is interrupted by downward movement of the elevator 310, the guide portion 118 and the guide member 308 form a developer guide passage, and the opening/closing member 306*a* is closed, under the control of the controller 62. That is, a collecting passage to collect the developer peeled off from the developing roller 68 is formed.

Figure 13C:
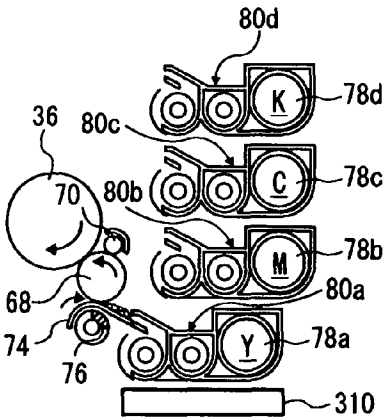

When the collecting passage to collect the developer has been formed, then as shown in FIG. 13C, in the developing device 34, the peeling member 76 rotates and peels off the yellow developer held on the developing roller 68, under the control of the controller 62.

Figure 13D:
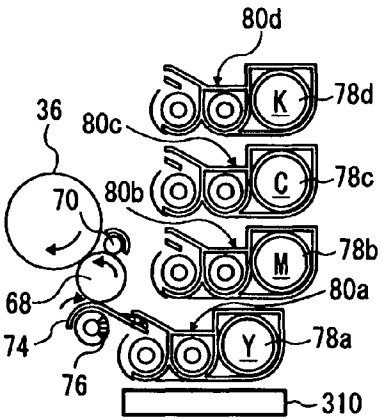

As shown in FIG. 13D, as the magnet 116 moves away from the guide portion 118, the yellow developer peeled off from the developing roller 68 is collected with the guide member 308 in the supply member main body 94 in a position different from the developer supply position.

Figure 13E:
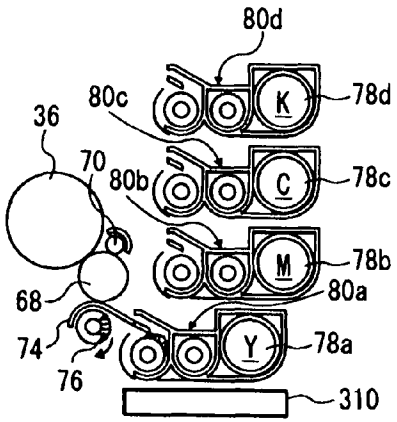

As shown in FIG. 13E, as the magnet 116 further rotates, all the yellow developer peeled off from the developing roller 68 is collected in the supply member main body 94.

Figure 13F:
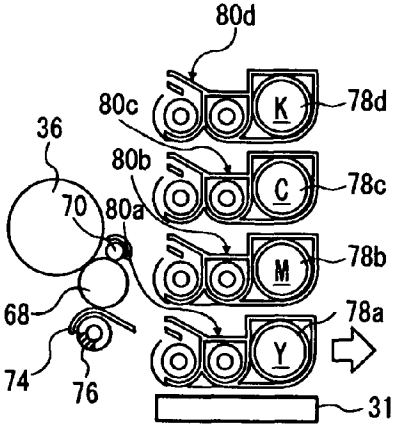

As shown in FIG. 13F, when all the yellow developer peeled off from the developing roller 68 has been collected in the supply member main body 94, the developer supply member 80*a* and the toner cartridge 78*a* withdraw from the developing roller 68.

Figure 13G:
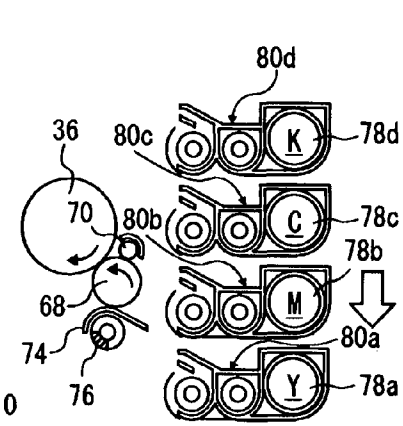

As shown in FIG. 13G, when the developer supply member 80*a* and the toner cartridge 78*a* have withdrawn from the developing roller 68, the elevator 310 moves downward such that the developer supply member 80*b* becomes opposite to the developing roller 68.

Figure 13H:
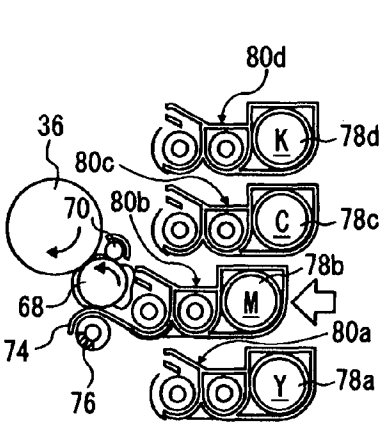

As shown in FIG. 13H, when the elevator 310 has moved downward and the developer supply member 80*b* has become opposite to the developing roller 68, the developing device 34 supplies magenta developer from the developer supply member 80*b* to the developing roller 68.

Note that in the above-described exemplary embodiment, an electrostatic latent image is visualized using two component developer; however, the developer is not limited to this type of developer. For example, the developing device 34 may visualize an electrostatic latent image using single component developer.

Further, the developer collected in the developer collecting member 86 may be conveyed by rotation of the rotary body 66 or upward/downward movement of the elevator 310 and collected in a predetermined collecting box or the like by its own weight.

Further, a collected developer container to contain developer peeled off and collected from the developing roller 68 may be provided in one position in the image forming apparatus 10, in the rotary body 66 or in the elevator 310.

Next, a third exemplary embodiment of the present invention will be described based on the drawings.

Figure 14:
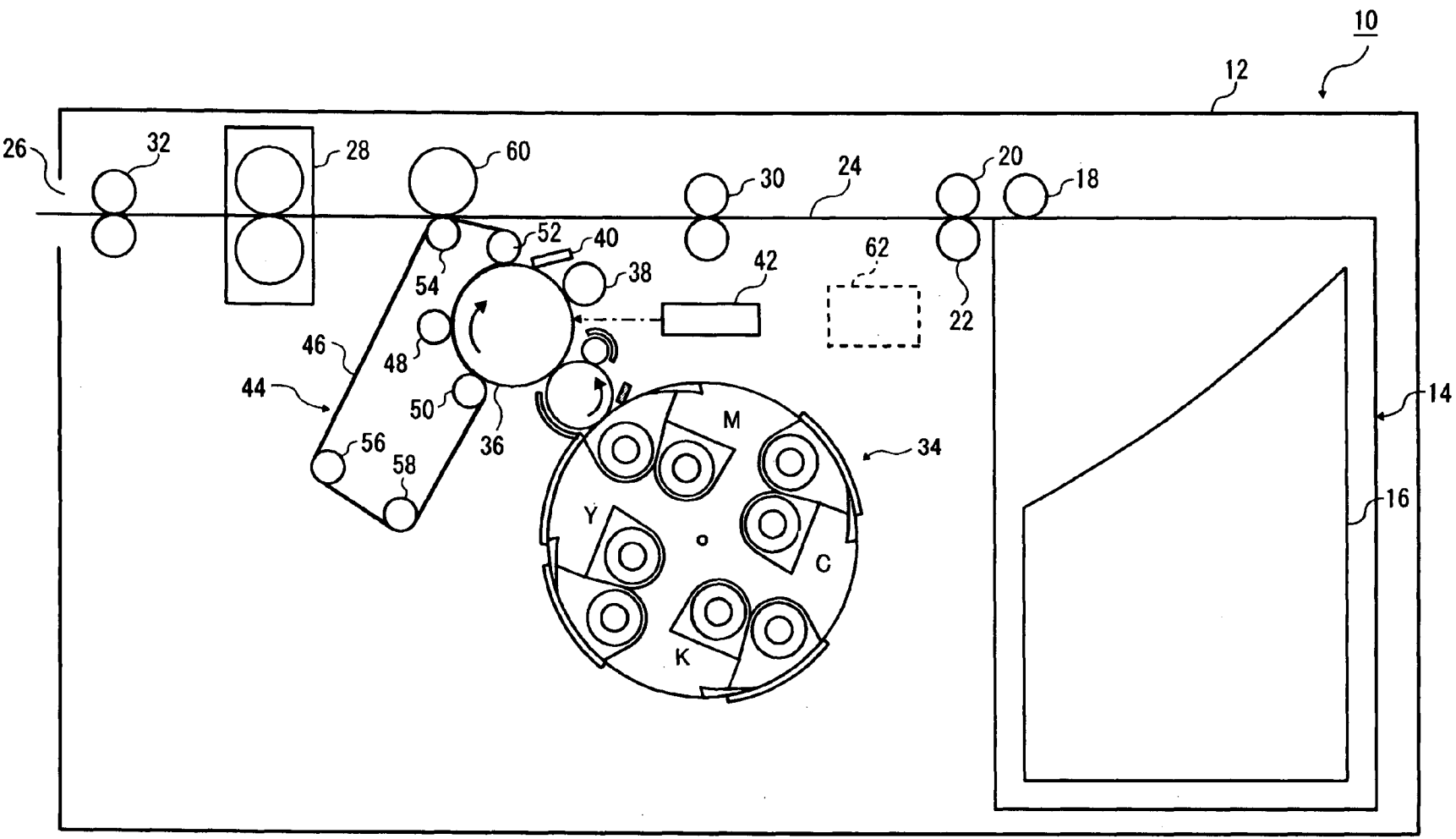
FIG. 14 is a cross-sectional view schematically showing the structure of the image forming apparatus according to a third exemplary embodiment of the present invention.

FIG. 14 is a cross-sectional view schematically showing the structure of the image forming apparatus 10 according to the third exemplary embodiment of the present invention. Note that in the image forming apparatus 10 according to the third exemplary embodiment of the present invention, constituent elements substantially the same as those of the image forming apparatus 10 according to the first exemplary embodiment shown in FIG. 1 have the same reference numerals.

Figure 15:
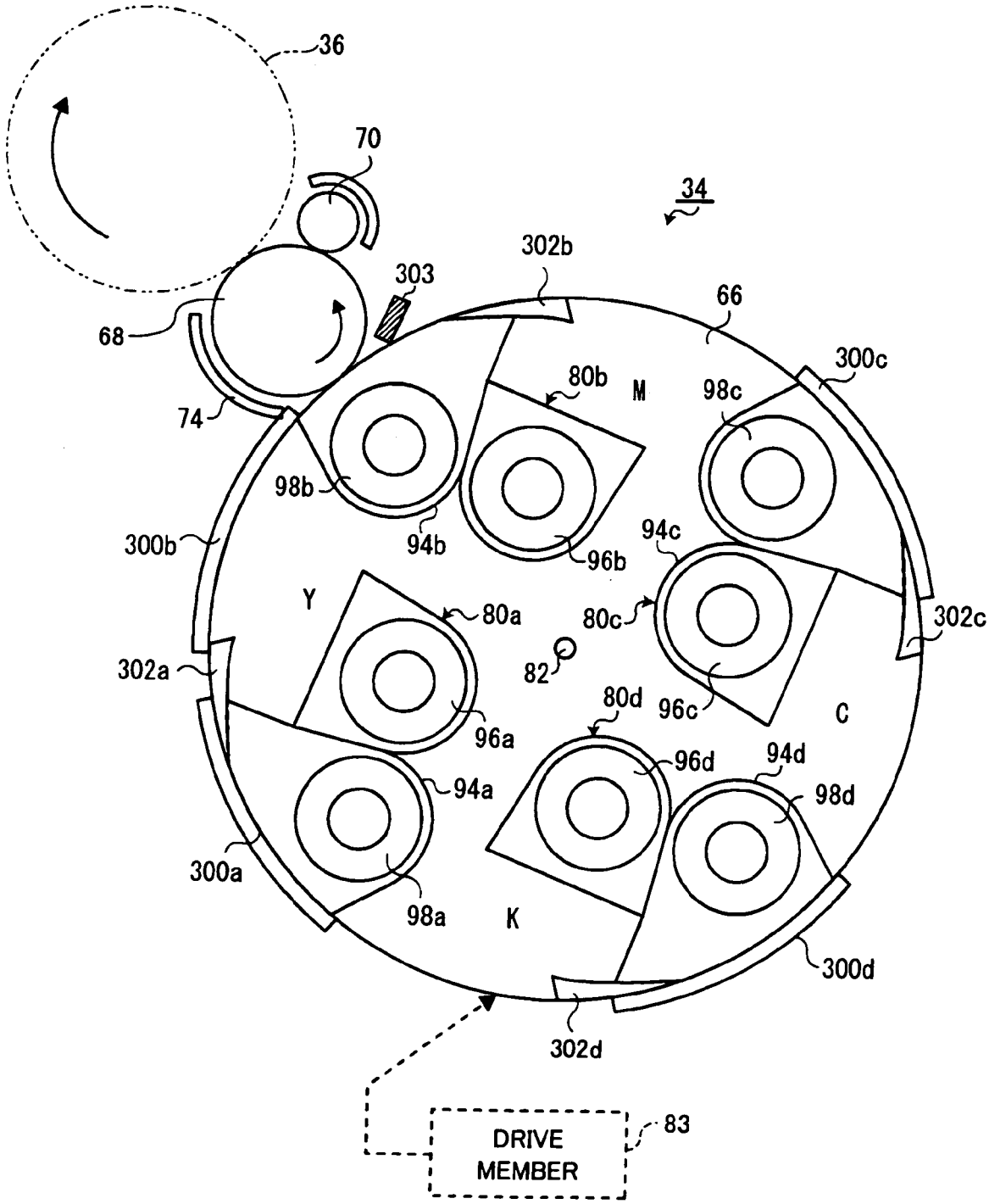
FIG. 15 is a cross-sectional view showing the developing device in the third exemplary embodiment of the present invention.

FIG. 15 is a cross-sectional view showing the developing device 34 of the image forming apparatus 10 according to the third exemplary embodiment of the present invention. Note that in the developing device 34 shown in FIG. 15, constituent elements substantially the same as those of the developing device 34 shown in FIG. 8 have the same reference numerals.

The developer supply members 80*a* to 80*d* to sequentially supply yellow, magenta, cyan and black developers to the developing roller 68 are removably provided in the rotary body 66. The rotary body 66 is rotated e.g. counterclockwise (counterclockwise in FIG. 15) by a driving force of a drive member 83 about a rotation shaft 82, such that the developer supply members 80*a* to 80*d* are moved to a position opposite to the developing roller 68 (developer supply position).

The developer supply member 80 has the supply member main body 94. The supply member main body 94 includes the first auger 96 and the second auger 98. The first auger 96 conveys developer, while stirring the developer, toward the second auger 98. The second auger 98 stirs the developer and supplies the developer to the developing roller 68. Further, the developer supply member 80 is provided with the opening/closing member 300 to prevent outflow of developer and the scraping member 302 to remove developer remaining on the developing roller 68 by making contact with the developing roller 68. The scraping member 302 is e.g. a magnetic body.

A guide member 303 to guide the scraping member 302 to make contact with the developing roller 68 from a predetermined direction such that the scraping member 302 does not damage the developing roller 68 is provided in the vicinity of a position where the developing roller 68 and the scraping member 302 are brought into contact with each other (upstream side of the rotary body 66 in its rotation direction).

Figure 16:
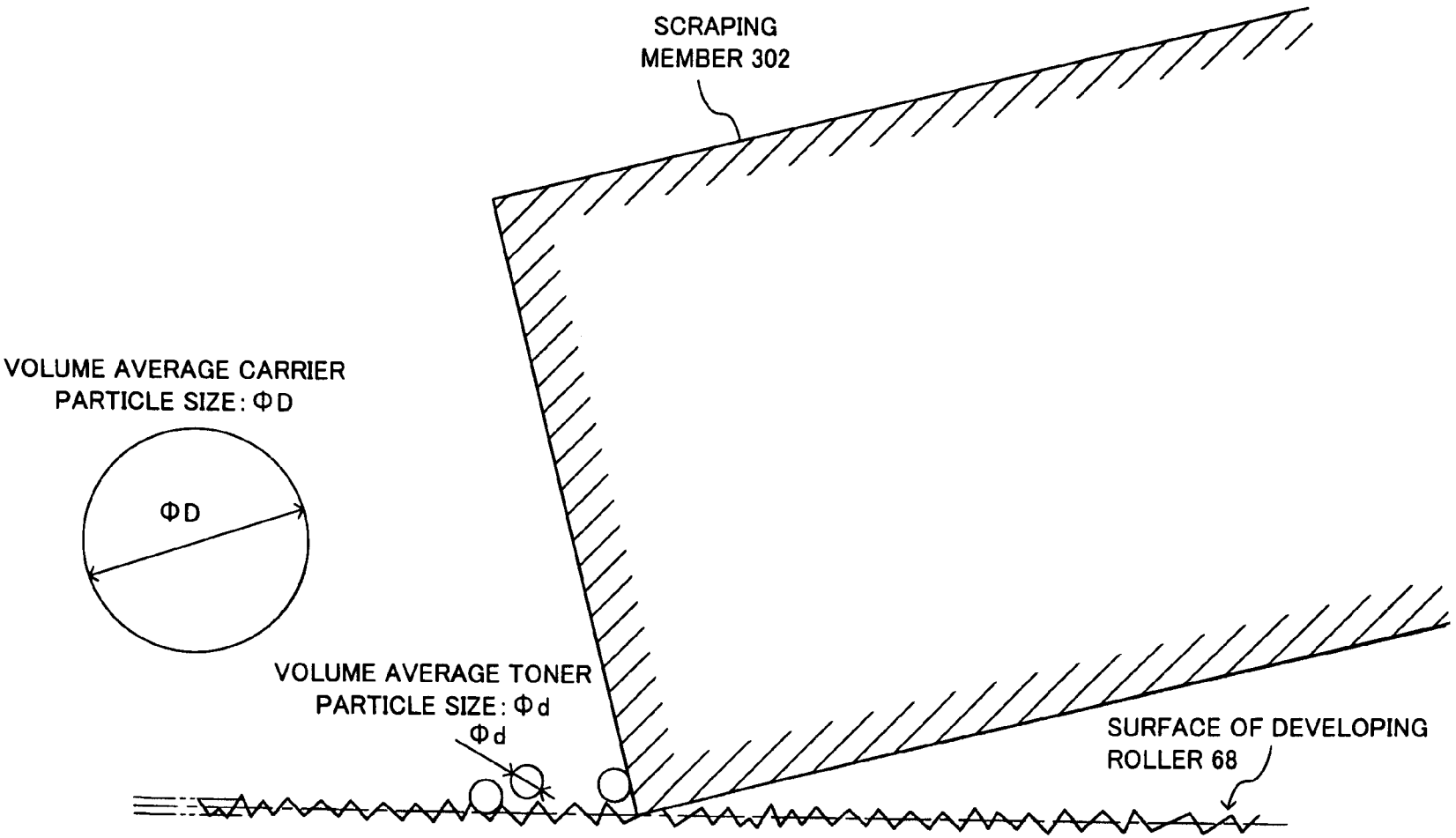
FIG. 16 is an expanded cross-sectional view showing a state where a scraping member removes developer remaining on the surface of a sleeve of the developing roller.

FIG. 16 is an expanded cross-sectional view showing a state where the scraping member 302 removes developer remaining on the surface of the developing roller 68.

The surface of the scraping member 302 is coated (surface processed) with a coating layer to prevent attachment of developer. For example, the coating layer of the scraping member 302 is a tetrahederal amorphous carbon film (ta-C film), a diamond-like carbon film (DLC film), a cubic crystal boron nitride film (C-BN film), a silicon carbide film (SiC film), a chrome nitride film (CrN film), a tungsten carbon film (W-C film) or other metalized film (Ti film) or the like.

In the developing roller 68, toner is half-exposed from the rough surface such that the toner is peeled off by the scraping member 302. For example, when Φd=5 μm holds as a volume average toner particle size, the surface roughness of the developing roller 68 is set to a value indicated with the following expression 1 or 2.

ten-points average surface roughness $$R_{zJIS}<d/2=5\ \mu m/2=2.5\ \mu m$$

$$R_{zJis}<2.5\ \mu m \quad (1)$$

arithmetic average of absolute values $$Ra<d/4=5\ \mu m/4=1.25\ \mu m$$

$$Ra<1.25\ \mu m \quad (2)$$

Note that the scraping member 302 may be a member to be distorted to make contact with the developing roller 68 from a predetermined direction when it has been guided by the guide member 303.

In this manner, the developer supply member 80 collects and reuses developer remained on the developing roller 68 after the supply of the developer.

The developing roller 68 (FIG. 15) including a magnet member extending in its axial direction rotates counterclockwise (counterclockwise in FIG. 15). Further, the developing roller 68 is accommodated in the developing roller accommodation wall 74 opened such that a portion opposite to the image carrying member 36 is exposed. The developing roller 68 supplies respective color developers held with its magnetic force to the image carrying member 36 while forming a predetermined gap between the roller and the image carrying member 36.

The layer thickness regulating member 70 regulates the layer thickness of developer attached to the surface of the developing roller 68 (held on the developing roller 68).

Figure 17C:
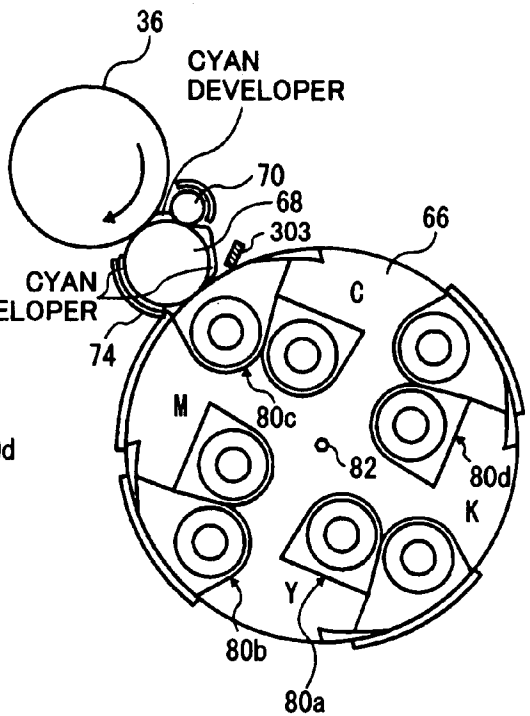
FIGS. 17A to 17C are cross-sectional views showing an operation example of the developing device according to the third exemplary embodiment of the present invention.
Figure 17B:
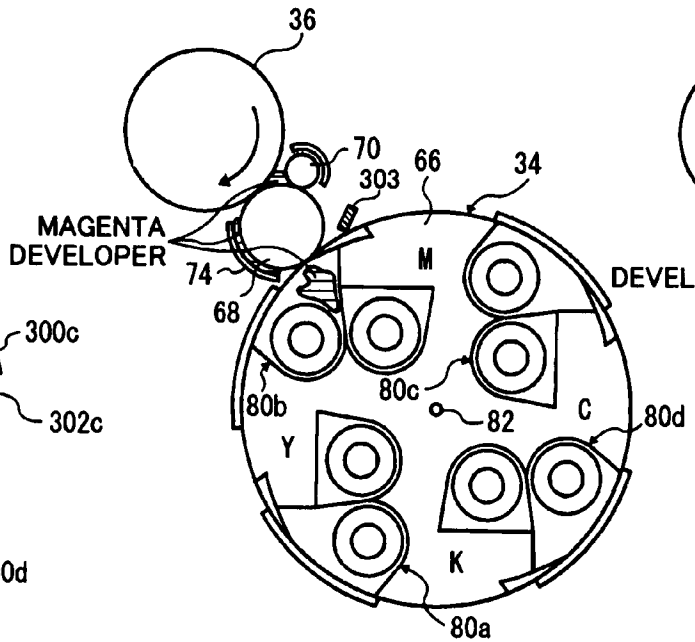
Figure 17A:
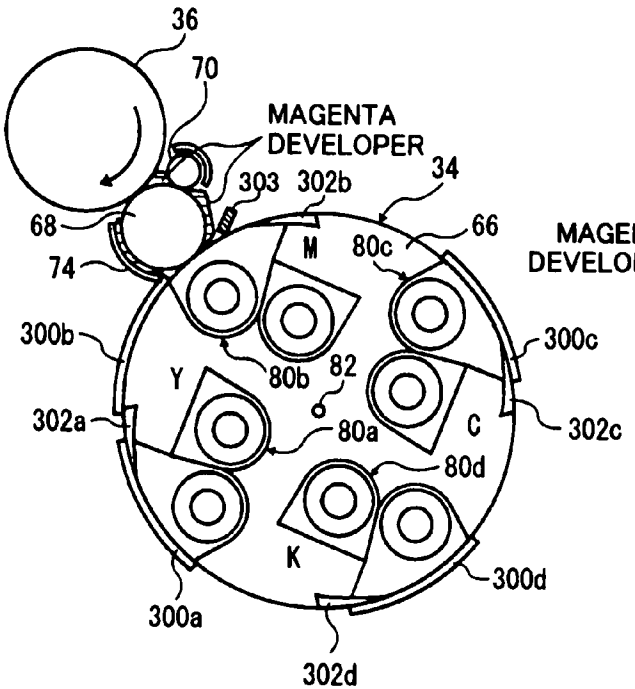

FIGS. 17A to 17C are cross-sectional views showing an operation example of the developing device 34 of the image forming apparatus 10 according to the third exemplary embodiment of the present invention. As shown in FIG. 17A, when the developing device 34 visualizes an electrostatic latent image with e.g. magenta developer, the developing roller 68 rotates while holding the magenta developer supplied from the developer supply member 80*b* positioned in the developer supply position.

When the visualization with the magenta developer has been completed, then as shown in FIG. 17B, in the developing device 34, the opening/closing member 300 of the developer supply member 80*b* moves by rotation of the rotary body 66 by e.g. 20°, the scraping member 302 is guided with the guide member 303 and brought into contact with the surface of the developing roller 68, and the scraping member 302 removes the developer remaining on the developing roller 68, under the control of the controller 62. The developer removed by the scraping member 302 is collected in the supply member main body 94 in a position different from the developer supply position.

Further, the supply of the developer from the developer supply member 80 to the developing roller 68 is interrupted by the contact between the scraping member 302 and the surface of the developing roller 68.

When the magenta developer peeled off from the developing roller 68 has been collected, then as shown in FIG. 17C, in the developing device 34, to visualize the electrostatic latent image with cyan developer, the rotary body 66 rotates 70° such that the developer supply member 80*c* becomes opposite to the developing roller 68. Note that the developing roller 68 rotates while holding the cyan developer supplied from the developer supply member 80*c*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrying member that supplies developer to an image carrying member;

a plurality of developer supply members, containing different color developers, that supply the developers to the developer carrying member in a developer supply position;

a rotary body that sequentially conveys the plurality of developer supply members to the developer supply position by rotating about a rotation shaft;

a peeling member that peels off developer, remained after supply of the developer by the developer carrying member to the image carrying member, from the developer carrying member; and a collecting member that collects the developer peeled off by the peeling member and is provided in the rotary body.

2. The developing device according to claim 1, further comprising a controller that controls the peeling member peeling off the developer from the developer carrying member by control of a rotation angle of the rotary body.

3. The developing device according to claim 2, wherein the controller selects a state where the plurality of developer supply members supply the developer to the developer carrying member or a state where supply of the developer from the plurality of developer supply members to the developer carrying member is interrupted, by controlling a rotation angle of the rotary body.

4. The developing device according to claim 2, wherein the collecting member collects the developer peeled off by the peeling member by control of a rotation angle of the rotary body by the controller.

5. The developing device according to claim 1, wherein the collecting member is provided in a position different from the developer supply position.

6. The developing device according to claim 1, further comprising a plurality of peeling members that peel off developer remaining on the developer carrying member by making contact with the developer carrying member.

7. The developing device according to claim 6, wherein the plurality of peeling members further have a function of individually interrupting supply of the developer from the plurality of developer supply members to the developer carrying member by making contact with the developer carrying member.

8. The developing device according to claim 6, wherein the plurality of peeling members respectively are magnetic bodies.

9. The developing device according to claim 6, wherein respective surfaces of the plurality of peeling members are coated with a coating layer that prevents attachment of developer.

10. The developing device according to claim 1, wherein ten-points average surface roughness of the developer carrying member is less than a half of a toner volume average particle size or arithmetic average of absolute values of the developer carrying member is less than a quarter of the toner volume average particle size.

11. The developing device according to claim 1, further comprising a collected developer container that contains the developer collected from the collecting member.

12. The developing device according to claim 1, wherein in a state where the rotary body has conveyed one of the plurality of developer supply members to the developer supply position, the collecting member is formed, and in a state where the collecting member is formed, the rotary body conveys any of the plurality of developer supply members to a position different from the developer supply position.

13. The developing device according to claim 1, further comprising a plurality of developer collecting members that become opposite to the peeling member in accordance with movement of the developer supply member, and collect the developer peeled off by the peeling member by change of a slope with respect to a gravity direction in correspondence with rotation of the rotary body.

14. The developing device according to claim 13, wherein the developer collecting member supplies the collected developer to the developer supply member in correspondence with the rotation of the rotary body.

15. The developing device according to claim 13, wherein the developer collecting member is integrally provided with the supplying developer container.

16. An image forming apparatus comprising:

an image carrying member;

a developer carrying member that supplies developer to the image carrying member;

a plurality of developer supply members, containing different color developers, that supply the developers to the developer carrying member in a developer supply position;

a rotary body that sequentially conveys the plurality of developer supply members to the developer supply position by rotating about a rotation shaft; a peeling member that peels off developer, remained after supply of the developer by the developer carrying member to the image carrying member, from the developer carrying member; and a collecting member that collects the developer peeled off by the peeling member and is provided in the rotary body.

17. The image forming apparatus according to claim 16, further comprising a controller that controls the peeling member peeling off the developer from the developer carrying member by control of a rotation angle of the rotary body.

18. A developer cartridge containing developer supplied to a developer supply member that supplies the developer to a developer carrying member to develop an image on an image carrying member in a developer supply position, and a collecting passage to collect developer peeled off by a peeling member that peels off developer remained after supply of the developer by control of a rotation angle of a rotary body to the image carrying member from the developer carrying member, in the process of movement of the developer supply member provided in the rotary body which rotates about a rotation shaft to change a color of the developer supplied to the developer carrying member.

19. A developing device comprising:

a developer carrying member that supplies developer to an image carrying member;

a plurality of developer supply members, containing different color developers, that supply the developers to the developer carrying member in a developer supply position;

a movable body that sequentially conveys the plurality of developer supply members to the developer supply position by moving upward/downward;

a peeling member that peels off developer, remained after supply of the developer by the developer carrying member to the image carrying member, from the developer carrying member; and a collecting passage that collects the developer peeled off by the peeling member to the plurality of developer supply members and is formed by movement of the movable body.

20. The developing device according to claim 19, further comprising a controller that collects the developer peeled off by the peeling member to the plurality of developer supply members by control upward/downward of the movable body.

21. The developing device according to claim 19, wherein the developer supply member is provided with an opening/closing member to prevent outflow of developer and a guide member to guide developer collected from the developer carrying member.

* * * * *